US008378954B2

(12) United States Patent
Brown

(10) Patent No.: US 8,378,954 B2
(45) Date of Patent: Feb. 19, 2013

(54) ACTIVE MATRIX LIQUID CRYSTAL DEVICE

(75) Inventor: Christopher J. Brown, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1144 days.

(21) Appl. No.: 12/225,093

(22) PCT Filed: Mar. 23, 2007

(86) PCT No.: PCT/JP2007/057006
§ 371 (c)(1),
(2), (4) Date: Sep. 12, 2008

(87) PCT Pub. No.: WO2007/108561
PCT Pub. Date: Sep. 27, 2007

(65) Prior Publication Data

US 2009/0102780 A1 Apr. 23, 2009

(30) Foreign Application Priority Data

Mar. 23, 2006 (GB) ..... 0605744.2

(51) Int. Cl.
*G09G 3/36* (2006.01)

(52) U.S. Cl. ..... 345/101; 345/87

(58) Field of Classification Search ..... 345/87–101
See application file for complete search history.

(56) References Cited

U.S. PATENT DOCUMENTS 3,921,162 A * 11/1975 Fukai et al. ..... 345/101
4,425,027 A 1/1984 Portmann
5,029,982 A 7/1991 Nash
5,377,030 A 12/1994 Suzuki et al.
5,510,807 A * 4/1996 Lee et al. ..... 345/103
5,926,162 A * 7/1999 Wood et al. ..... 345/101

(Continued)

FOREIGN PATENT DOCUMENTS

EP 0 012 479 6/1980
JP 60-043490 3/1985

(Continued)

OTHER PUBLICATIONS

International Search Report (PCT/ISA/210).

(Continued)

*Primary Examiner* — Viet Pham
(74) *Attorney, Agent, or Firm* — Harness, Dickey & Pierce

(57) ABSTRACT

An active matrix liquid crystal device comprises an active matrix substrate (1) and a counter electrode substrate separated by a layer of liquid crystal material. A temperature sensing capacitor (11) comprises electrodes on the substrates separated by the liquid crystal layer, which thus forms the dielectric of the capacitor. A reference capacitor ($C_{REF}$) and a calibration capacitor ($C_{CAL}$) are also provided and have nominally the same capacitance. These capacitors form part of charge-transfer capacitance measuring branches (25, 26, 30) within a sample/hold circuit (12). During a calibration cycle, the sample/hold circuit (12) provides a signal dependent on the difference between the capacitances of the calibration capacitor ($C_{CAL}$) and the reference capacitor ($C_{REF}$) and this is supplied to an analog/digital converter (20-22, 31, 32), which forms a reference voltage. During subsequent parts of the measurement cycle, the converter converts the output of the sample/hold circuit using the reference voltage in order to improve the accuracy of measurement of the liquid crystal capacitor (11), and hence the temperature of the liquid crystal material. This temperature measurement may be used, for example, to compensate the AMLCD for the effects of temperature variation in the liquid crystal properties.

33 Claims, 24 Drawing Sheets

U.S. PATENT DOCUMENTS

| | | | | |
|---|---|---|---|---|
| 5,988,860 | A * | 11/1999 | Hefferen et al. | 700/276 |
| 6,333,728 | B1 | 12/2001 | Libsch et al. | |
| 6,414,740 | B1 * | 7/2002 | Hosoyamada | 349/161 |
| 6,614,416 | B1 * | 9/2003 | Yamamoto et al. | 345/94 |
| 6,819,163 | B1 * | 11/2004 | Gregoire, Jr. | 327/536 |
| 2003/0083795 | A1 * | 5/2003 | Stanley | 701/45 |

FOREIGN PATENT DOCUMENTS

| | | | |
|---|---|---|---|
| JP | 07-230079 | | 8/1995 |
| JP | 09-072757 | | 3/1997 |
| JP | 2000-089199 | | 3/2000 |
| JP | 2000-356976 | | 12/2000 |
| JP | 2002-140047 | | 5/2002 |
| JP | 2003-075486 | | 3/2003 |
| JP | 2003-248209 | | 9/2003 |
| JP | 2003248209 | A * | 9/2003 |

OTHER PUBLICATIONS

Great Britain Search Report.

Roubik Gregorian. "Introduction to CMOS Op-Amps and Comparators." John Wiley and Sons, Inc., 1999.

Graham Cairns et al. "Multi-Format Digital Display with Content Driven Display Format." Society for Information Display Technical Digest, 2001. pp. 102-105.

USPTO Office Action dated Aug. 1, 2012 for co-pending U.S. Appl. No. 12/225,237.

Office Action for corresponding U.S. Appl. No. 12/225,237 dated Apr. 25, 2012.

* cited by examiner

ACTIVE MATRIX LIQUID CRYSTAL DEVICE

TECHNICAL FIELD

The present invention relates to an active matrix liquid crystal device (AMLCD).

BACKGROUND ART

Display devices utilising liquid crystal (LC) have historically suffered degraded image quality through loss of contrast ratio as a result of temperature-induced changes in the optical properties of the liquid crystal material. In particular, the voltage-transmission curve of a liquid crystal is related to its temperature, as shown in FIG. 1 of the accompanying drawings.

A well-known solution for this degradation in image quality is to provide a temperature controlled contrast ratio compensation system comprising means for measuring the temperature of the display and means for altering the voltages applied to the display based on this measurement. Such a system is disclosed for a segmented liquid crystal display in EP0012479 and for an AMLCD in U.S. Pat. No. 5,926,162.

Alternatively, a temperature control system may be provided comprising means for measuring the temperature of the display and a heating element to maintain the display at a constant temperature. Such a system is disclosed in JP7230079. In general, systems based on the heating element method are undesirable compared to the driving voltage compensation method due to the increased power consumption associated with the heating element.

Conventional solutions for measuring the temperature rely on attaching a discrete temperature detection element to the display, for example as disclosed in U.S. Pat. No. 5,029,982. Disadvantages of this method include: indirect measurement of the liquid crystal temperature (it is the temperature of the glass, or substrate on which the detection element is mounted, that is actually being measured and not the LC); extra connections to the display reducing reliability; and extra components and fabrication steps raising the cost.

In order to reduce fabrication cost, a liquid crystal temperature sensor may be fabricated with the temperature detection element integrated on the display substrate itself, as disclosed in U.S. Pat. No. 6,414,740. In this disclosure, the temperature detection element is a thin-film diode or thin-film transistor that has a temperature related drain current measured by circuitry separate to the display substrate. Thus the device still has the disadvantages of performing indirect measurement of temperature and requiring extra connections to the display. An additional disadvantage is that the process variation typical of elements integrated onto the display substrate limits the accuracy of such systems.

U.S. Pat. No. 6,333,728 discloses an improved arrangement in which the temperature detection element is formed as a liquid crystal capacitor. The advantage of using a liquid crystal capacitor as the temperature detection element is that it has a one to one transfer function when relating the sensed temperature to the optical performance of the display pixels. The transient response of the liquid crystal capacitor to an input ramp voltage is used as a measure of temperature. In a first embodiment, a differentiator is used to detect the maximum rate of change of this transient response and a peak detection circuit is subsequently used to generate a voltage corresponding to the location of the maximum rate. This voltage is compared with a reference and a heating element is switched on/off according to the relative value. In a second embodiment, a switch arrangement is used to sample the transient response at a defined time. The voltage sampled at this defined time is a function of the capacitance of the liquid crystal element and hence of the temperature. A differential integrator compares the sampled voltage with a reference and its output is used to control the heating element.

In both above embodiments, the system supplies an output voltage corresponding to the difference between a measured temperature-dependant voltage and a reference voltage. Whilst this is suitable for on/off control of a heating element, as in a control loop, disadvantageously the system does not supply a measure of absolute temperature as would be required in a preferred driving voltage compensation system. It is unlikely that this system may be modified to achieve accurate absolute temperature measurements in a practical display system for the following reasons:

- the transient response approach to measuring the capacitance of the liquid crystal element requires a ramp input voltage of constant slope. This is difficult to achieve in practice requiring a significant increase in complexity of the display driving circuits;
- it is difficult to accurately define capacitor values, including the liquid crystal capacitor element, in practice. Reference voltages and timing signals supplied to the system therefore need to be uniquely calibrated for each display.

DISCLOSURE OF INVENTION

According to the invention, there is provided an active matrix liquid crystal device comprising: an active matrix first substrate; a second substrate carrying a common electrode for the active matrix; a layer of liquid crystal material between the first and second substrates; a temperature sensing first capacitor comprising first and second electrodes on the first and second substrates, respectively, separated by the liquid crystal layer, which forms the first capacitor dielectric; a reference second capacitor; a calibration third capacitor of substantially the same capacitance as the second capacitor; a differential sample/hold circuit for supplying a first signal dependent on the difference between the capacitances of the second and third capacitors during a calibration cycle of a measurement cycle and for supplying a second signal dependent on the difference between the capacitances of the first and second capacitors during a sampling cycle of the measurement cycle; and an analog/digital converter arranged to convert the first signal to a reference voltage used in the converter during conversion of the second signal to a measure of the capacitance of the first capacitor.

It is thus possible to provide an arrangement which automatically calibrates an AMLCD for errors, for example introduced by manufacturing tolerances. Such an arrangement also provides compensation, for example, for non-idealities such as charge-injection from transistor switches within the device. No additional connections are required and no external calibration steps are needed. Such an arrangement is therefore capable of providing a more accurate measure of the capacitance of a temperature sensing capacitor with the liquid crystal layer of the device forming the dielectric, and hence of the temperature of the liquid crystal material of the layer.

The second electrode may comprise part of the common electrode.

The first and second signals may comprise first and second voltages, respectively.

The first, second and third capacitors may be part of first, second and third capacitance to voltage converting circuits, respectively. Each of the converting circuits may comprise a first electronic switch for connecting the respective one of the first to third capacitors to a predetermined voltage for charging thereof, a transfer capacitor, a second electronic switch between the respective capacitor and the transfer capacitor for sharing charge therebetween, a third electronic switch for connecting the transfer capacitor to an output of the converting circuit, and a fourth electronic switch for discharging the transfer capacitor. Each of the first to fourth electronic switches may comprise a transistor formed on the first substrate.

The converter may comprise an integrating converter. The converter may comprise an integrating amplifier, and integrating fourth capacitor arranged to be connected in a feedback loop of the integrating amplifier during the calibration cycle for integrating the first signal to form the reference voltage and to be disconnected from the feedback loop after the calibration cycle for making the reference voltage available, and an integrating fifth capacitor arranged to be connected in the feedback loop after the calibration cycle.

The converter may be a dual slope converter. The device may comprise a discharge sixth capacitor, the sample/hold circuit being arranged to supply a third signal dependent on the different between the second and sixth capacitors during a conversion cycle of the measurement cycle. The device may comprise a comparator for comparing the output of the integrating amplifier with the voltage reference.

The device may comprise an offset compensation arrangement for the integrating amplifier. The compensation arrangement may comprise a seventh capacitor and electronic switching arrangement arranged, during an offset compensation cycle of the measurement cycle, to configure the integrating amplifier as an inverting unity gain amplifier with the seventh capacitor arranged to store the output voltage and, subsequent to the offset compensation cycle, to connect the seventh capacitor to an input of the integrating amplifier.

The measurement cycle may comprise a D.C. balancing cycle for applying voltages to the first capacitor for substantially balancing the polarity of the field applied across the liquid crystal forming the dielectric thereof.

The sample/hold circuit and the converter may be formed on the first substrate.

The device may comprise an arrangement, responsive to the measure of the capacitance of the first capacitor, for supplying temperature-compensated drive signals to the cells of the matrix.

The resulting measure may be used to compensate for the effects of temperature, for example in the case of a liquid crystal display. Where such displays are used in environments with substantially varying temperatures, compensation can be provided so as to reduce any loss in display quality such as reduction in contrast ratio. It is possible for all of the circuitry associated with measuring the capacitance to be formed within the device so that no additional connections between the device and other components are required. This arrangement may be incorporated with no modification to the design or operation of, for example, device driver circuits or the pixel matrix. A relatively accurate measure of the liquid crystal material temperature may therefore be obtained and may be used to provide high quality compensation for temperature variations in the display performance.

BRIEF DESCRIPTION OF DRAWINGS

The invention will be further described, by way of example, with reference to the accompanying drawings, in which.

Like reference numerals refer to like parts throughout the drawings.

BEST MODE FOR CARRYING OUT THE INVENTION

Figure 1:
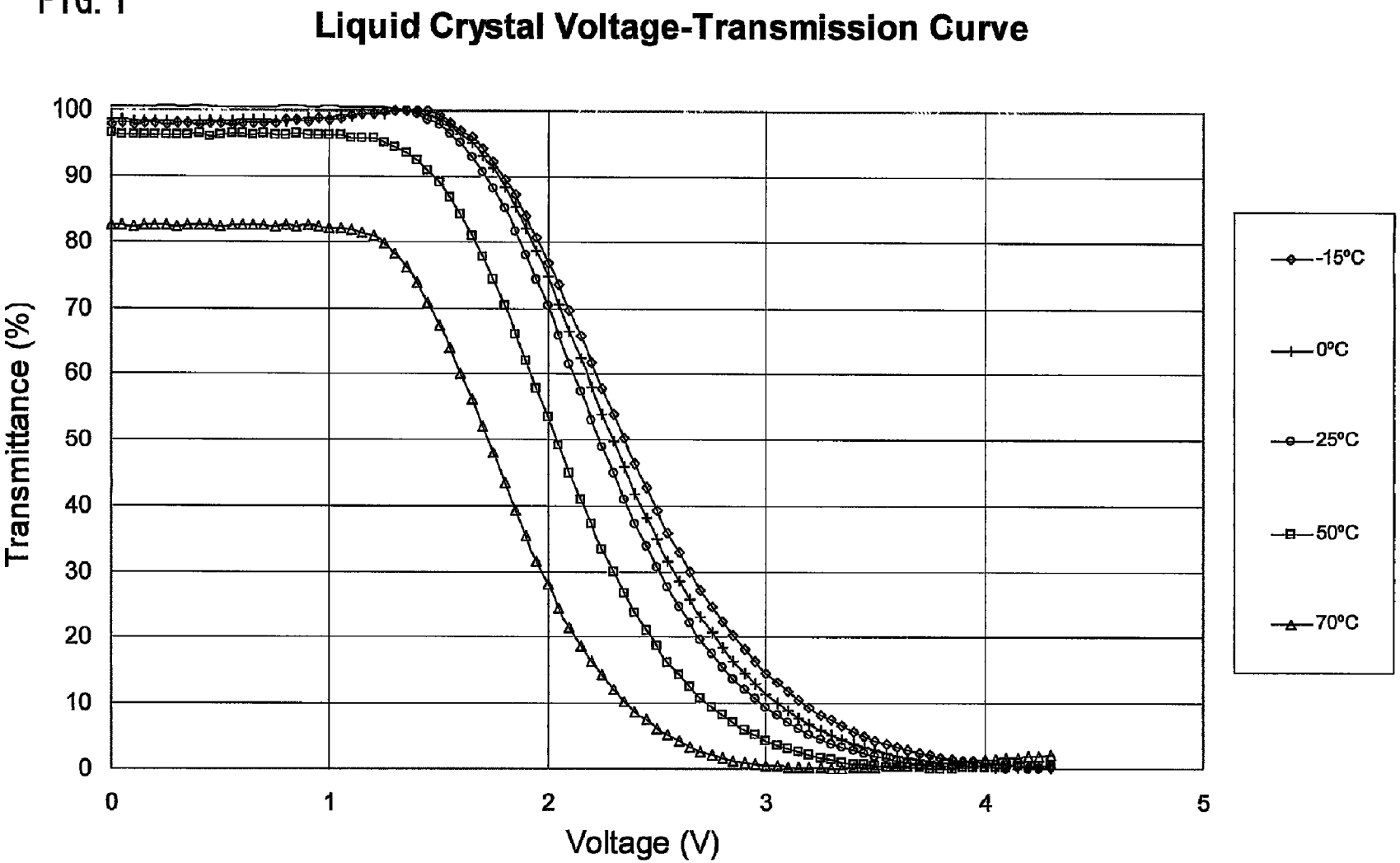
FIG. 1 is a graph of transmittance in percentage of maximum transmittance against pixel drive voltage illustrating the transfer characteristics for several different temperatures of an active matrix liquid crystal device (AMLCD)

As mentioned hereinbefore, the performance of an active matrix liquid crystal device (AMLCD), such as the display performance of a display, varies with the temperature of the liquid crystal material of the device. FIG. 1 illustrates how the transfer function between pixel drive voltage and pixel transmittance varies for a range of temperatures to which such a device may be subjected during operation. For example, such devices may be used to provide displays in vehicles and may be subjected to a very wide range of temperatures. In order to reduce the effects of temperature variations on display performance, compensation has to be provided.

Figure 2:
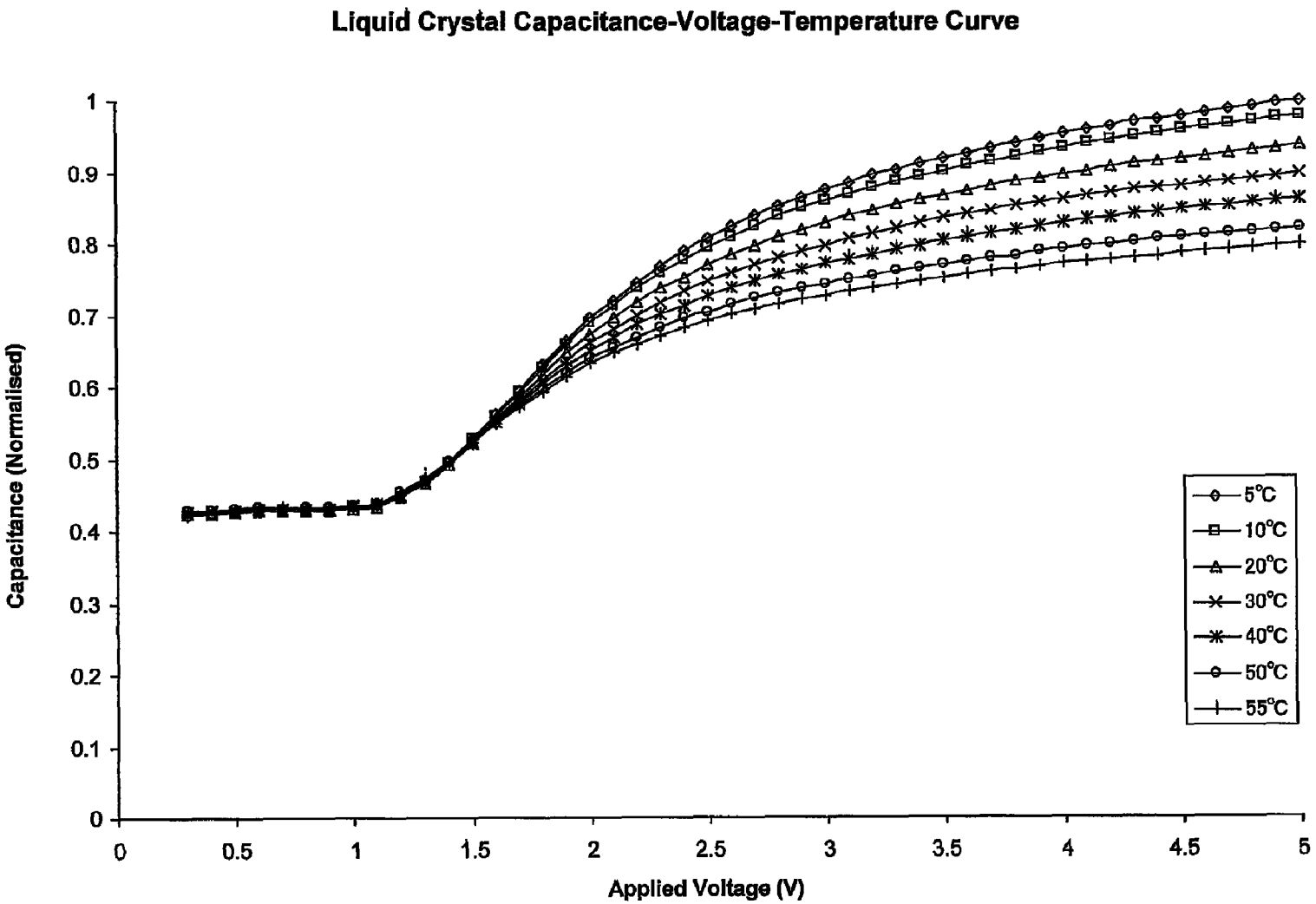
FIG. 2 is a graph of (normalised) capacitance against applied voltage of a liquid crystal sensing capacitor in an AMLCD for a plurality of temperatures.

As mentioned hereinbefore, the capacitance of a liquid crystal capacitor whose dielectric is formed by the liquid crystal material of the device may be used to provide a measure of the actual temperature of the liquid crystal material and this measure may be used in an arrangement for providing temperature compensation. However, the capacitance of such a liquid crystal capacitor is also dependent on the voltage applied across the liquid crystal layer and FIG. 2 illustrates this variation for a range of temperatures.

Figure 3:
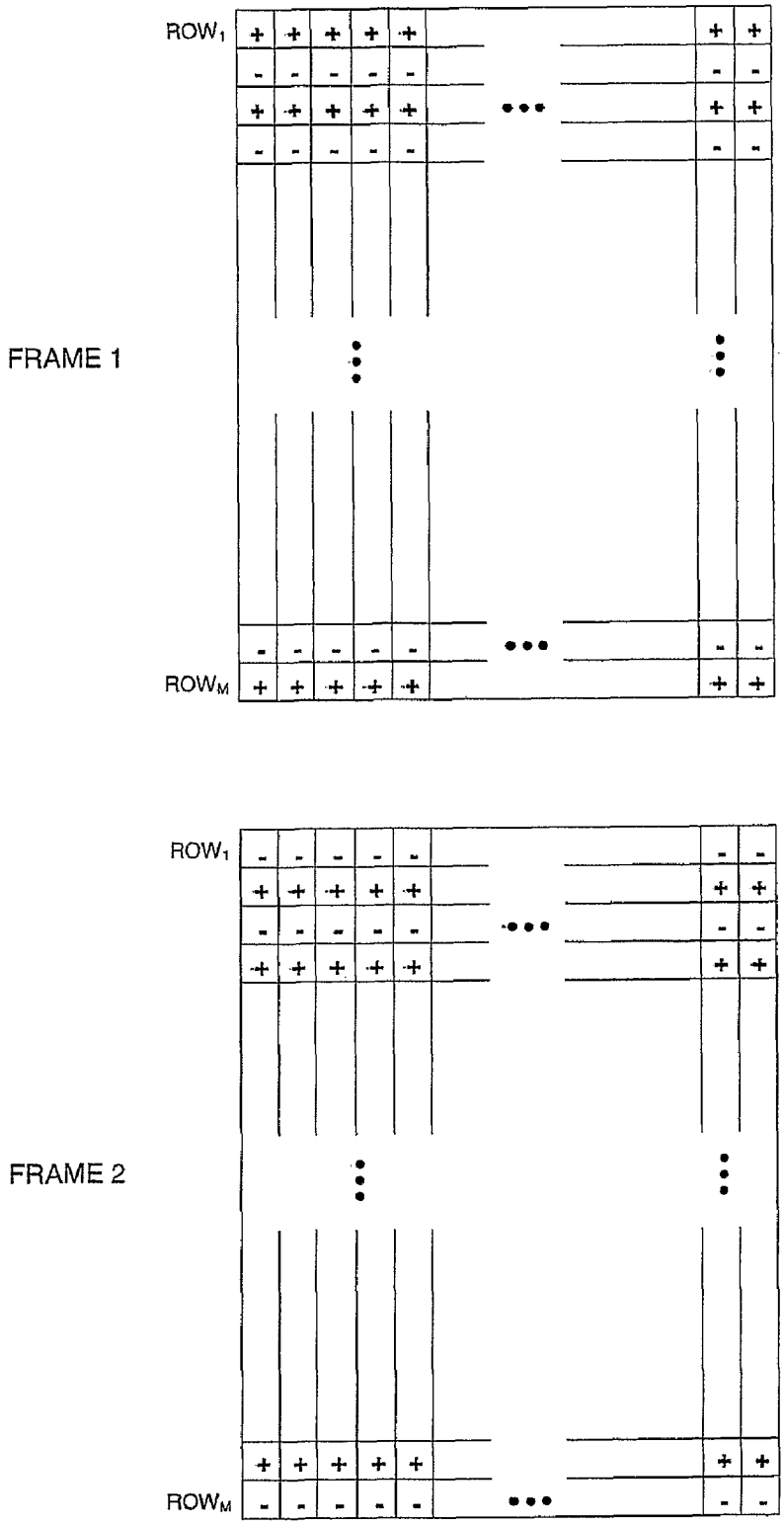
FIG. 3 illustrates diagrammatically consecutive frames of a row inversion addressing scheme for an AMLCD.

In order to avoid or greatly reduce degradation of the liquid crystal material of such a device, it is known to reverse periodically the polarity of the drive signals applied to the individual pixel cells so that, over a period of operation, there is substantially no net direct component of the applied voltage and hence of the applied field. A known technique for achieving this is referred to as "row inversion" and this is illustrated in FIG. 3. The device is refreshed a frame at a time and, within each frame, the pixels are refreshed with display data a row at a time. In the first frame of each consecutive pair of frames, positive drive signals are supplied to the odd-numbered rows $ROW_1, \ldots, ROW_M$ and negative drive signals are supplied to the even-numbered rows. In the second frame of the consecutive pair, the polarities of the row drive signals are inverted so that each row receives positive drive signals in one frame and negative drive signals in the next frame during operation of the device.

Figure 4:
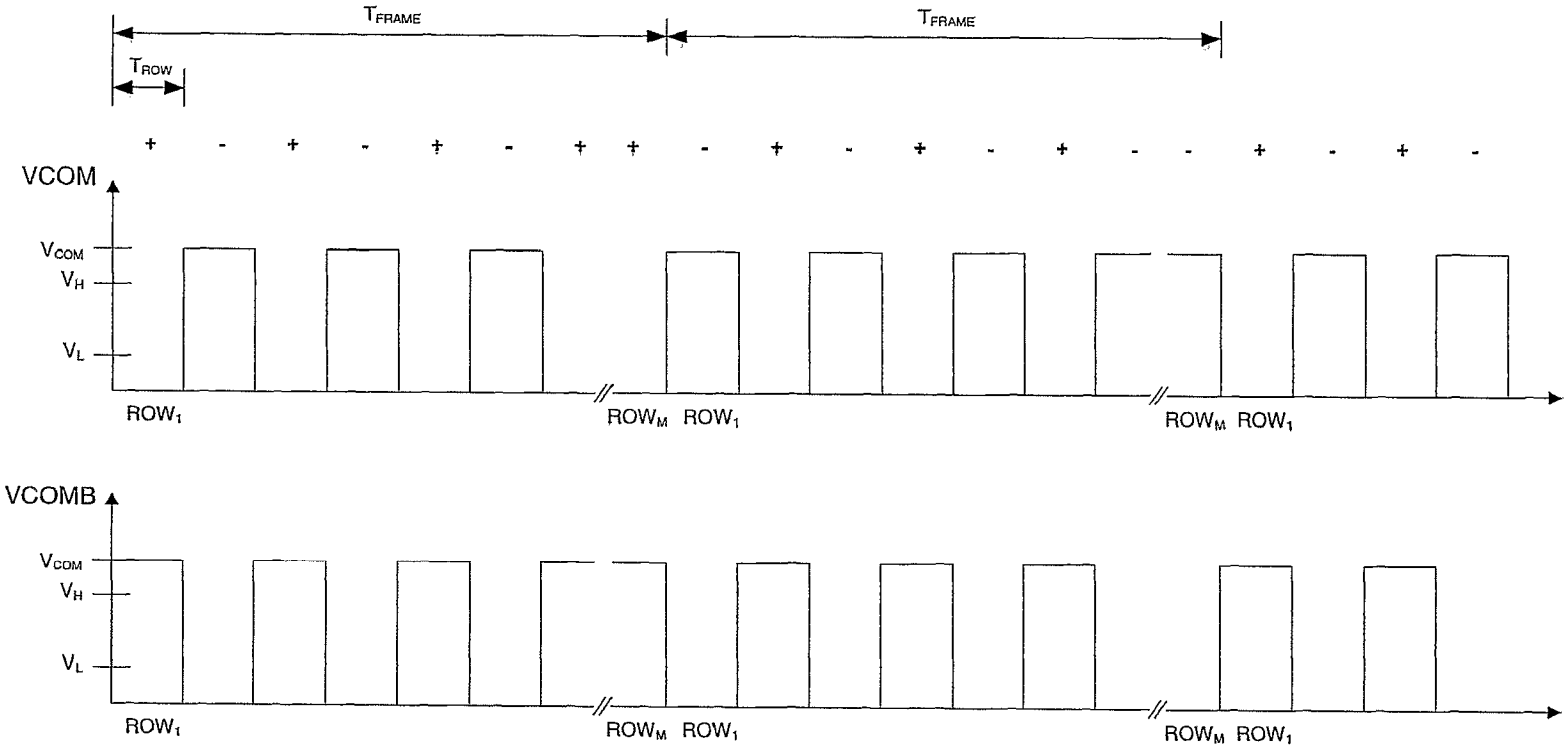
FIG. 4 comprises waveform diagrams illustrating the voltage or potential of a common or counter electrode for the row inversion scheme illustrated in FIG. 3.

FIG. 4 illustrates the voltage or potential VCOM, and its inverse or complement VCOMB, as used in a row inversion addressing scheme of the type illustrated in FIG. 3. The potential is switched between a maximum positive value $V_{COM}$ and a minimum zero value. This potential is supplied to a common or "counter" electrode which is common to all of the pixels and forms a continuous layer on a substrate facing an active matrix substrate of the device with the liquid crystal layer between the substrates. Drive signals are supplied to the individual pixel electrodes on the active matrix substrate to select the desired transmittance and these drive signals vary between a highest voltage $V_H$ and a lowest voltage $V_L$ in order to achieve the desired pixel transmittance. During row periods when the counter electrode potential is at $V_{COM}$, $V_H$ represents maximum pixel transmittance whereas $V_L$ represents minimum transmittance (or white and black, respectively). During row periods when the counter electrode potential is zero, $V_H$ represents minimum transmittance and $V_L$ represents maximum transmittance. Intermediate drive voltages provide grey scale display and image data for display are generated and supplied in accordance with the row inversion scheme.

Figure 5:
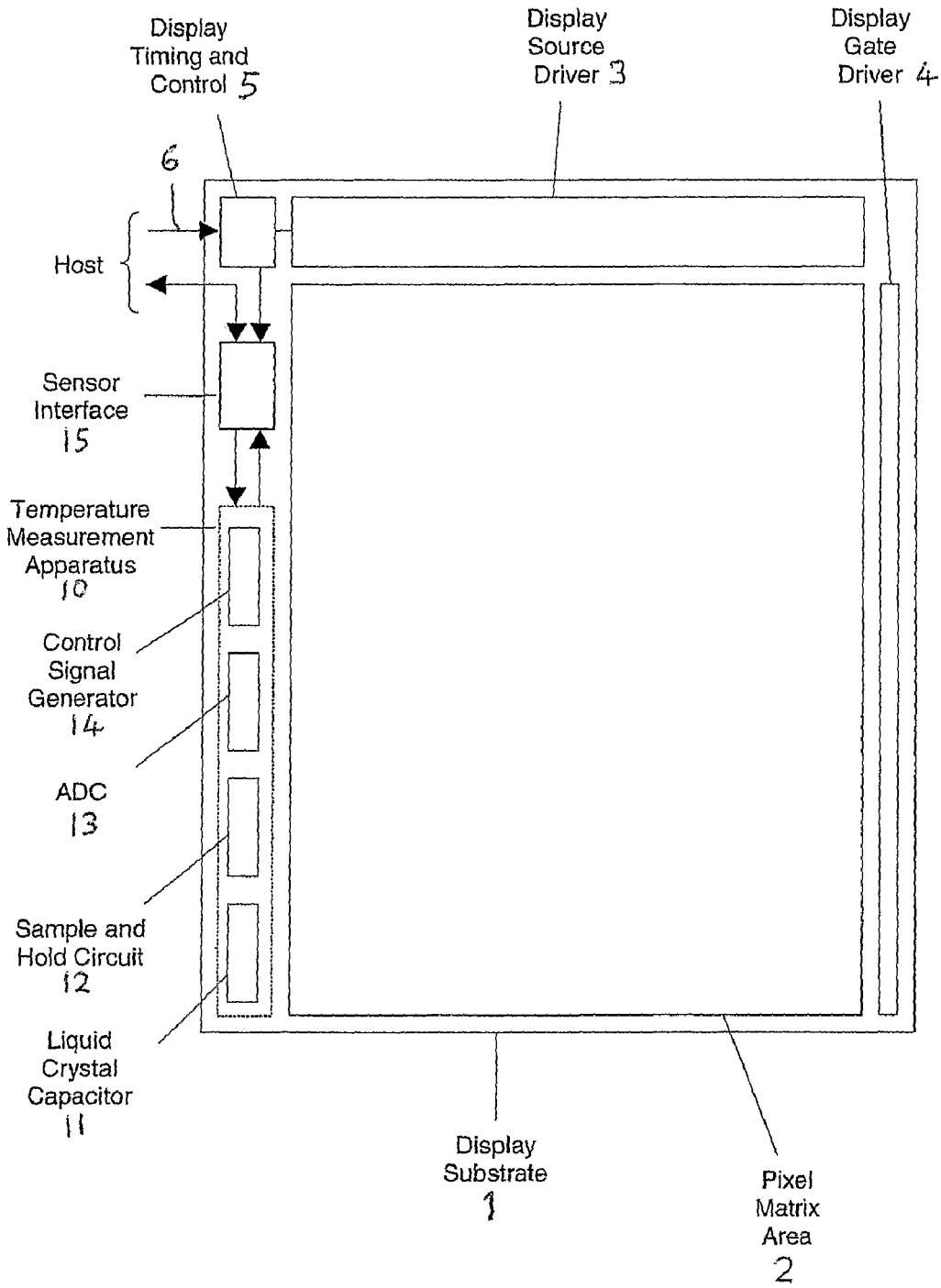
FIG. 5 illustrates diagrammatically the layout of an AMLCD constituting an embodiment of the invention.

FIG. 5 illustrates schematically the layout of an AMLCD constituting an embodiment of the invention. In particular, FIG. 5 illustrates the layout of an active matrix display first substrate 1, which hides from view a counter second substrate carrying a plane, common electrode covering substantially the whole area of the counter substrate and arranged to receive the voltage VCOM illustrated in FIG. 4. The substrates carry other layers, for example alignment layers, and are spaced apart to define a cavity containing a liquid crystal material. Polarises, colour filters, retarders, and other components may be provided as necessary in order to form a complete device such as a display.

The display substrate 1 comprises a pixel matrix area 2 over most of the area of the substrate. A display source driver 3 and a display gate driver 4 are disposed along two adjacent edges of the substrate 1 and perform active matrix addressing of the pixel matrix. A display timing and control arrangement 5 controls refreshing of image data, which it receives from a "host" at an input 6. Such arrangements are well known and will not be described further.

The device shown in FIG. 5 also comprises a temperature measurement apparatus 10. The apparatus comprises a liquid crystal first capacitor 11, which comprises a first electrode formed on the substrate 1 cooperating with the common electrode on the counter substrate forming the second capacitor electrode and with the liquid crystal layer providing the capacitor dielectric. The capacitor 11 is connected to a sample and hold circuit 12, which repeatedly prechanges the capacitor 11 to a fixed stable known magnitude of voltage, and measures the capacitance of the capacitor 11 in synchronism with addressing of the pixel matrix. The voltage dependency of the capacitor 11 may thus be accounted for and a more accurate measure of capacitance, and hence temperature, may be obtained. For convenience, the capacitance may be measured with the same voltage magnitude, and maybe polarity, across the liquid crystal capacitor 11 so as to avoid the voltage-dependent effects illustrated in FIG. 2. The capacitance of the capacitor 11 is thus substantially only a function of the liquid crystal temperature, with voltage-dependent effects greatly reduced or eliminated, and thus provides a measure of the actual liquid crystal temperature.

The output of the circuit 12 is supplied to an analog/digital converter (ADC) 13, which converts the measured signal to a corresponding digital value. A control signal generator 14 generates control signals for controlling the operation of the apparatus 10. The output of the ADC 13 is supplied to a sensor interface 15, which supplies control signals to the apparatus 10 from the host and from the arrangement 5. The measure of the liquid crystal temperature is used to compensate for the temperature variations illustrated in FIG. 1. For example, the measured temperature may be supplied to the host, which generates the appropriate image data so as to compensate for differences in temperature of the liquid crystal material from the nominal working temperature of the device.

Figure 6:
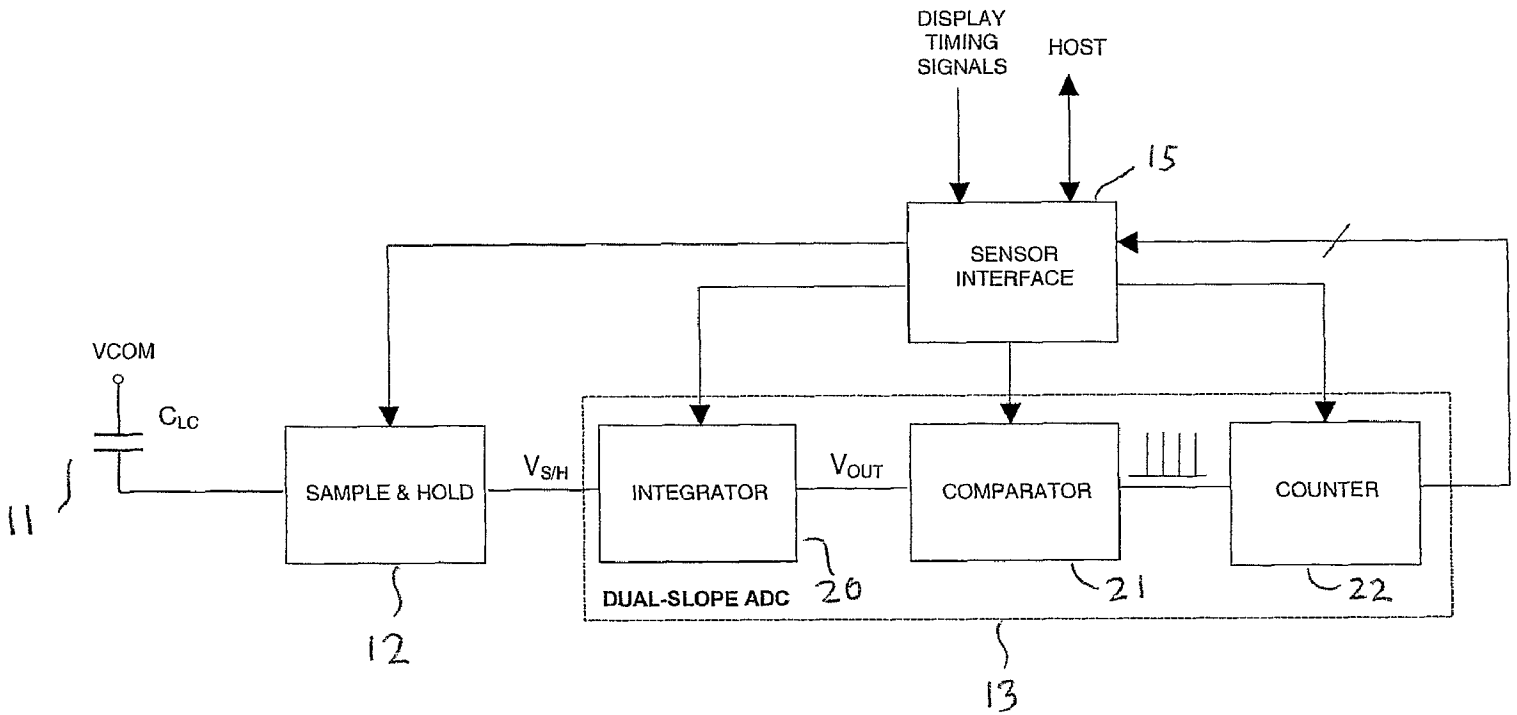
FIG. 6 is a block schematic diagram illustrating a temperature sensing arrangement of the AMLCD of FIG. 5.

As shown in FIG. 6, only the electrode of the capacitor on the display substrate 1 is accessible and this is connected to the input of the sample and hold circuit 12. The capacitance of the capacitor 11 is denoted by $C_{LC}$ and varies with the liquid crystal material temperature. The output $V_{S/H}$ of the circuit 12 is supplied to the ADC 13, which is in the form of a dual-slope ADC. Thus, the ADC comprises an integrator 20, whose output $V_{OUT}$ is supplied to a comparator 21. The output of the comparator 21 is supplied to a counter 22, which forms the digital output signals of the ADC 13. The basic operation and structure of a dual-slope ADC are well known and only those aspects of structure and performance which are relevant to the use of such a device in the AMLCD shown in FIG. 5 will be described in detail hereinafter.

Figure 7:
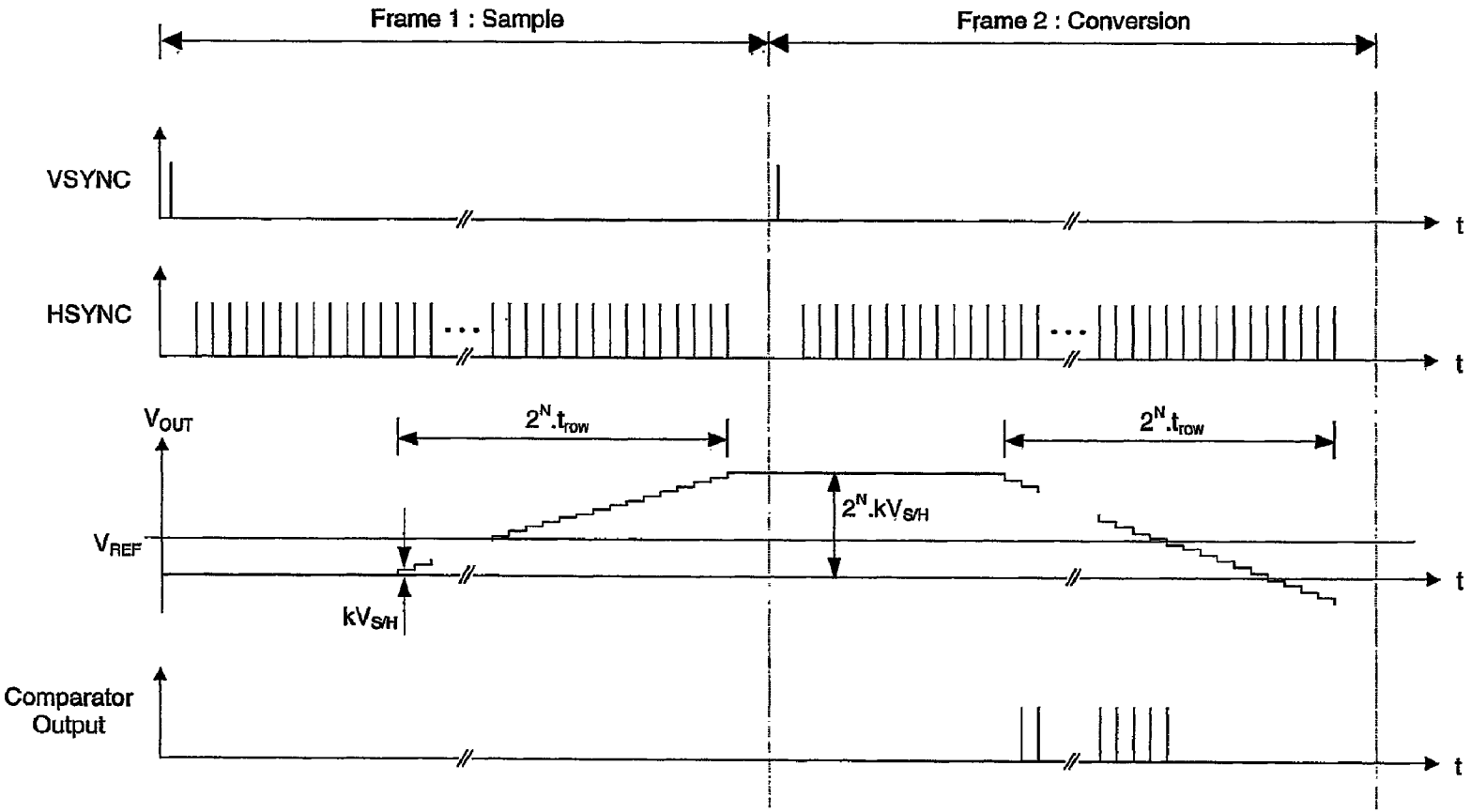
FIG. 7 is a diagram illustrating waveforms occurring in the arrangement shown in FIG. 6.

Vertical and horizontal synchronising signals VSYNC and HSYNC are illustrated in FIG. 7 together with the output of the integrator 20 and the output of the comparator 21. During a first frame refresh operation of the AMLCD forming a "sampling" frame of the apparatus 10, the sample and hold circuit 12 generates the voltage $V_{S/H}$ proportional to the capacitance $C_{LC}$ of the liquid crystal capacitor 11. During $2^N$ row refresh periods, where N is the number, of bits of the counter 22, the integrator 20 increments its output voltage by $kV_{S/H}$, where k is the integrator constant, so that, after the $2^N$ selected rows, which are the last $2^N$ refreshed rows in the frame, the output voltage $V_{OUT}$ of the integrator is equal to $2^N \cdot kV_{S/H}$. In practice and as described in more detail hereinafter, the integrator 20 actually integrates a difference signal representing the difference between the capacitance $C_{LC}$ of the capacitor 11 and the capacitance $C_{REF}$ of a reference capacitor, whose capacitance is independent of temperature and is arranged to be less than or equal to the minimum value of the capacitance $C_{LC}$. The integrator 20 thus receives a positive signal at its input and produces an up-slope at its output.

During the second "conversion" frame, the sample and hold circuit 12 generates a voltage which is proportional to the difference between the capacitance of the reference capacitor and that of a discharge capacitor, whose capacitance is independent of temperature and is arranged to be a known amount less than the reference capacitor. The input signal for the integrator 20 is thus negative and the integrator produces a down-slope at its output.

The comparator 21 compares the output voltage $V_{OUT}$ of the integrator 20 with a reference voltage $V_{REF}$ and produces an output pulse for each row refresh period during which the output voltage is greater than the reference voltage. The reference voltage $V_{REF}$ may be a known fixed potential or may be generated during an additional calibration frame as described hereinafter. For each output pulse from the comparator 21, the counter 22 is incremented by one count so that, at the end of the conversion frame, the output of the counter 22 is proportional to the difference in capacitance between the liquid crystal, capacitor 11 and the reference capacitor.

The whole of the apparatus 10 is formed on the display substrate 1 so that only minimal external connections are required. For example, the apparatus 10 may be formed from transistors and other components integrated on the display substrate in the form of polycrystalline silicon thin-film transistor circuitry.

Figure 8:
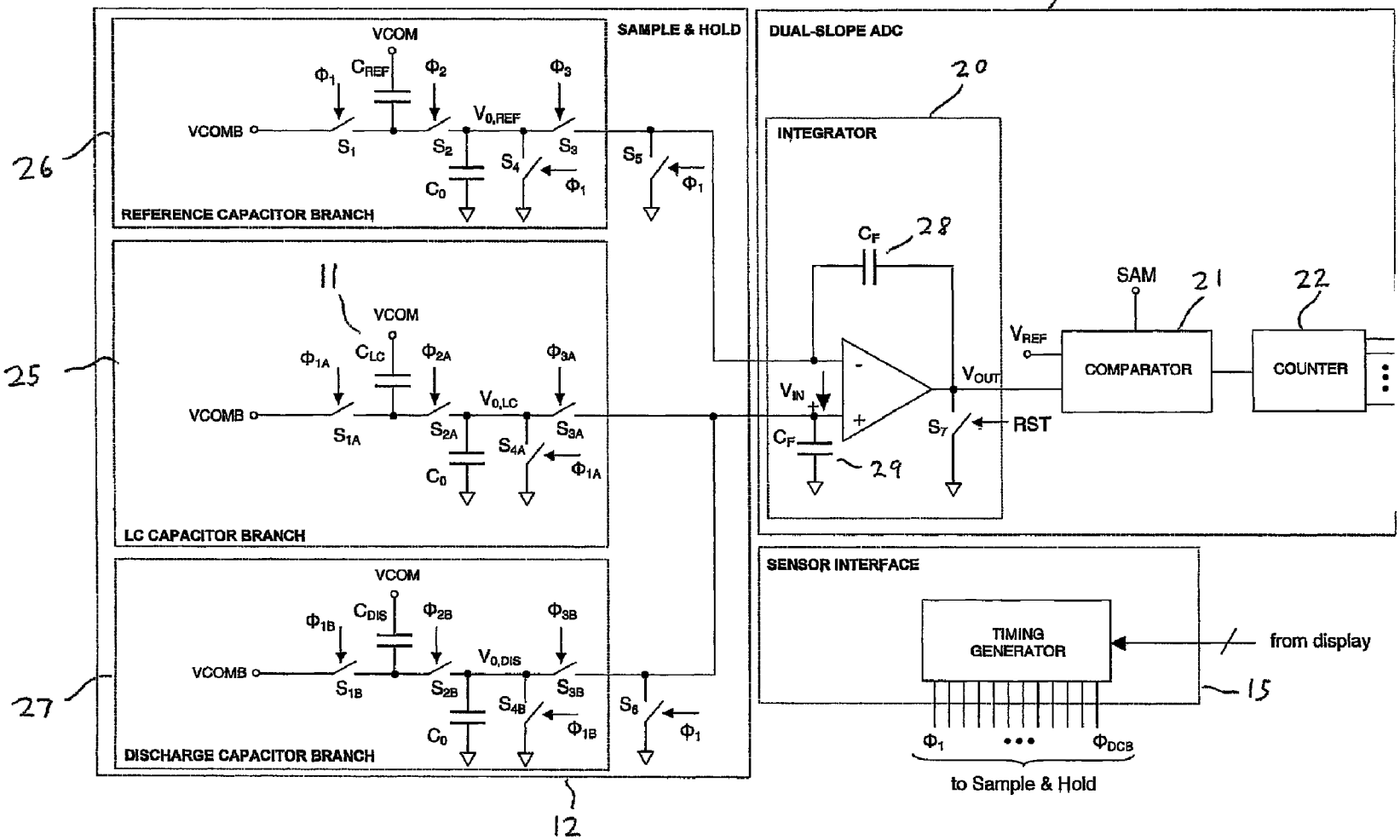
FIG. 8 is a circuit diagram illustrating a first example of the arrangement shown in FIG. 6.

A first example of the apparatus is shown in more detail in FIG. 8. The sensor interface 15 comprises a timing generator, which supplies multiple phase clock signals $\Phi_1, \ldots, \Phi_{DCB}$, some or all of which are used by the sample and hold circuit 12 and the ADC 13. The clock signals divide each row refresh period into a plurality of phases for performing the measurement.

The liquid crystal first capacitor 11 is shown as part of the circuit 12 within a liquid crystal capacitor branch 25. The branch 25 comprises electronic switches (for example formed by thin film transistors) and forms a first capacitance to voltage converting circuit. A first electronic switch $S_{1A}$ is closed only during a clock phase signal $\Phi_{1A}$ to charge the available plate of the capacitor 11 to the voltage of the complement VCOMB of the potential VCOM supplied to the common electrode. A second electronic switch $S_{2A}$ is closed only during a clock phase signal $\Phi_{2A}$ to connect a transfer capacitor of capacitance $C_O$ to the liquid crystal capacitor 11 so as to perform charge transfer such that the voltage across the transfer capacitor is proportional to the charge held in the previous phase in the liquid crystal capacitor 11 and hence is proportional to the capacitance $C_{LC}$ of the liquid crystal capacitor. During the clock phase signal $\Phi_{1A}$, a fourth electronic switch $S_{4A}$ is closed so as to discharge the transfer capacitor in readiness for charge transfer. During a clock phase signal $\Phi_{3A}$, a third electronic switch $S_{3A}$ is closed so as to connect the transfer capacitor to a non-inverting or "positive" input of the integrator 20.

A reference capacitor, branch 26 is connected to the "negative" or inverting input of the integrator 20 and comprises a reference second capacitor of capacitance $C_{REF}$, a transfer capacitor of capacitance $C_O$, first and fourth electronic switches $S_1$ and $S_4$ controlled by the clock phase signal $\Phi_1$, and second and third electronics switches $S_2$ and $S_3$ controlled by clock phase signals $\Phi_2$ and $\Phi_3$, respectively. The branch 26 forms a second capacitance to voltage converting circuit. The circuit 12 further comprises a discharge capacitor branch 27 comprising a discharge sixth capacitor of capacitance $C_{DIS}$, a transfer capacitor of capacitance $C_O$, switches $S_{1B}$ and $S_{4B}$ controlled by a clock phase signal $\Phi_{1B}$, and switches $S_{2B}$ and $S_{3B}$ controlled by clock phase signals $\Phi_{2B}$ and $\Phi_{3B}$, respectively. The output of the discharge capacitor branch 27 is also connected to the non-inverting input of the integrator 20. The inputs of the integrator 20 are connected, to ground during the clock phase signal $\Phi_1$ by switches $S_5$ and $S_6$.

The integrator 20 is illustrated as a differential integrator having integrating capacitors 28 and 29 of capacitance $C_F$. The output of the integrator is provided with a reset switch $S_7$ for resetting the integrator at the start of each cycle of operation.

Figure 9:
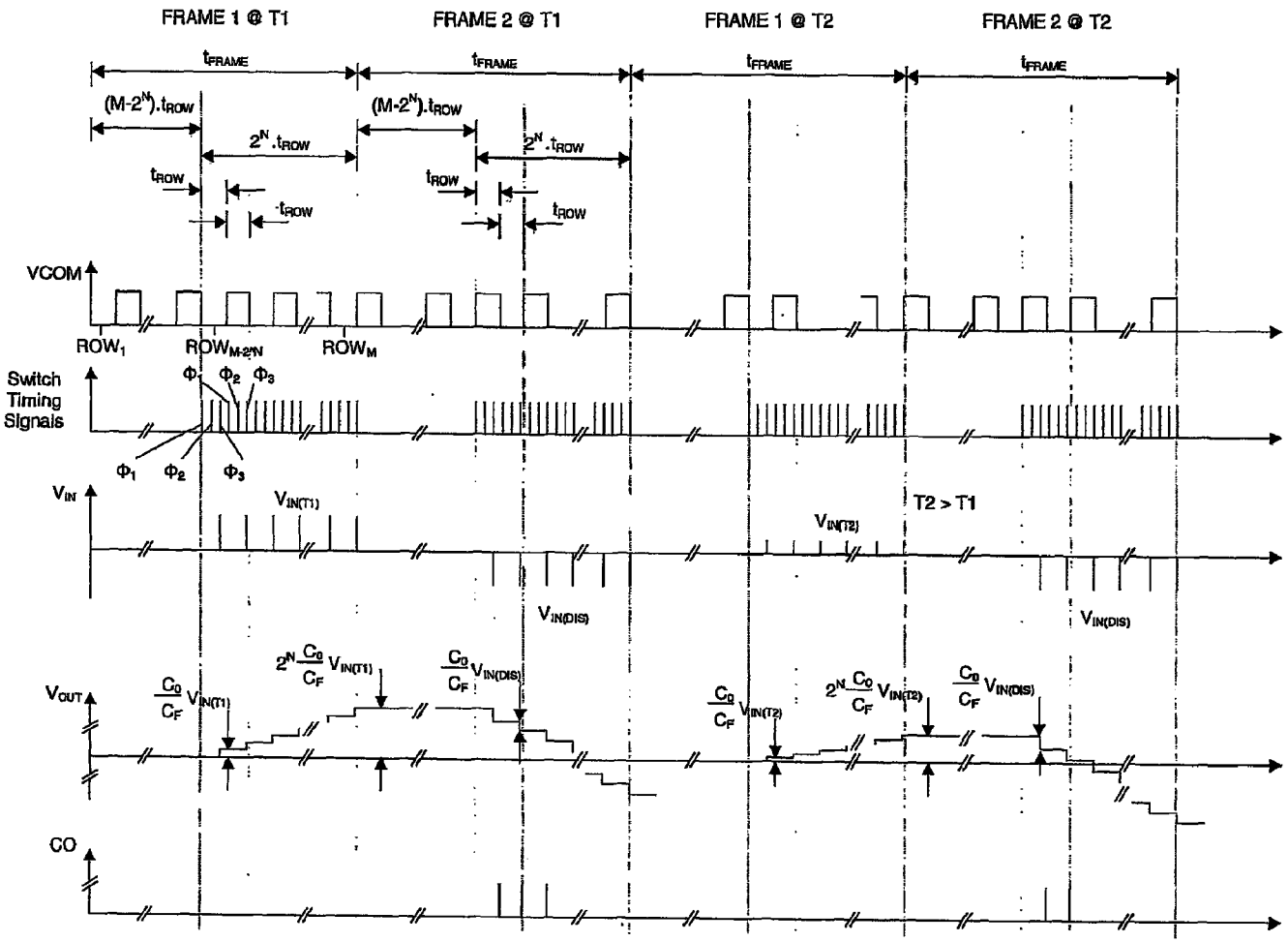
FIG. 9 is a waveform diagram illustrating operation of the example shown in FIG. 8.
Figure 10:
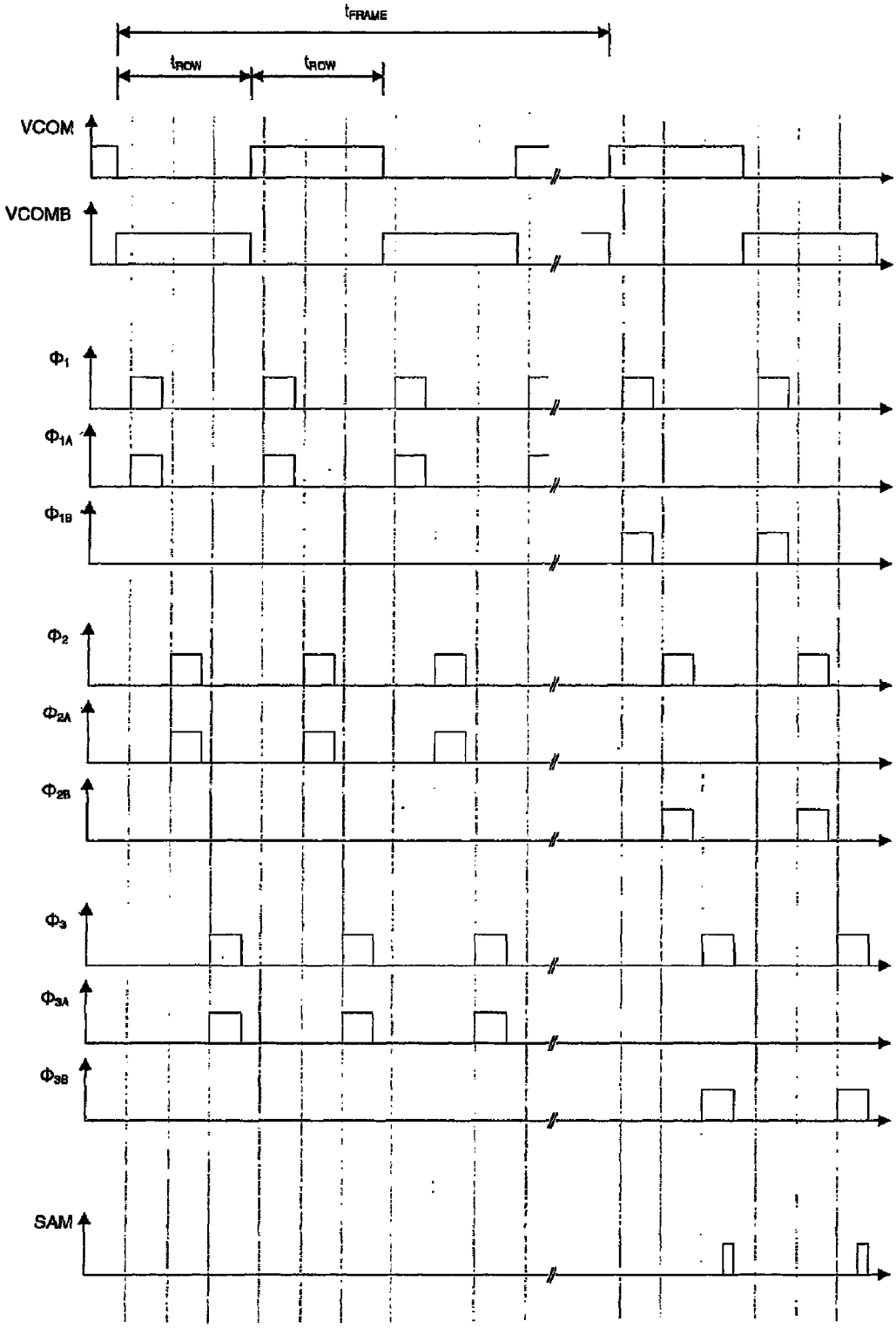
FIG. 10 is a timing diagram illustrating the timing of signals in the example shown in FIG. 8.

Each complete conversion cycle of operation takes place in two consecutive frame refresh periods of the AMLCD. Two full conversion cycles are illustrated by the waveform diagram of FIG. 9 and FIG. 10 illustrates the clock, phase timing during a first frame and part of a second frame of a conversion cycle.

A signal from the display gate driver 4 may be used to select the rows in which the sample and hold circuit 12 is active. For example, the $(M-2^N)$th row scan signal of the display gate driver may be used to initiate the up and down slopes of the integrator 20 as illustrated in FIG. 9, where M is the number of rows of the AMLCD and N is the number of output bits of the counter 22. Alternatively, the signals may be supplied externally although this is less desirable because the number of connections to the AMLCD would have to be increased.

During the first "sampling" frame of each conversion cycle, the liquid crystal capacitor branch 25 and the reference capacitor branch 26 are active. The clock phase signals $\Phi_1$-$\Phi_3$ and $\Phi_{1A}$-$\Phi_{3A}$ comprise two sets or non-overlapping clock phase signals for the switches of the sample and hold circuit 12 and are enabled in turn during the last 2N display row periods as illustrated in FIG. 9. The timing of the individual clock phase signals is illustrated in FIG. 10.

When the clock phase signals $\Phi_1$ and $\Phi_{1A}$ are simultaneously active, the switches $S_1$, $S_{1A}$, $S_4$, $S_{4A}$, $S_5$ and $S_6$ are closed whereas the other switches are open. The voltage VCOMB is transferred to the first electrodes of the liquid crystal capacitor 11 and the reference capacitor $C_{REF}$ so that the voltages across both capacitors are equal to VCOM-VCOMB. These voltages are illustrated in FIG. 4. The transfer capacitors $C_O$ and the integrator input terminals are reset to ground potential during this phase.

During the next phase corresponding to clock phase signals $\Phi_2$ and $\Phi_{2A}$, the switches $S_2$ and $S_{2A}$ are closed whereas the other switches are open so that charge sharing occurs between the liquid crystal and reference capacitors and the corresponding transfer capacitors in the branches 25 and 26. The terminals of the transfer capacitors connected during this phase to the liquid crystal and reference capacitors rise to potential given by $C_{LC} \cdot VCOMB/(C_{LC}+C_O)$ and $C_{REF} \cdot VCOMB/(C_{REF}+C_O)$. The output voltage of the sample and hold circuit 12 is the difference between these voltages and is positive because $C_{REF}$ is less than or equal to the minimum expected liquid crystal capacitance $C_{LC}$. This output voltage is approximately proportional to the difference between the capacitance $C_{LC}$ of the liquid crystal capacitor and the capacitance $C_{REF}$ of the reference capacitor During the clock phase signals $\Phi_3$ and $\Phi_{3A}$, the switches $S_3$ and $S_{3A}$ are closed whereas the other switches of the circuit 12 are open. The output voltage of the circuit 12 is applied between the differential inputs of the integrator 20 and this results in the output $V_{OUT}$ of the integrator being incremented by the product of the sample and hold circuit output voltage and $(C_O/C_F)$, where $C_F$ is the capacitance of the integrating or feedback capacitor 28. This process is repeated for the $2^N$ row periods of the sampling frame, at the end of which the output voltage of the integrator 20 is equal to $2^N (C_O/C_F) V_{IN}$, where $V_{IN}$ is the input voltage supplied to the integrator 20.

During the following "conversion" frame, the reference capacitor branch 26 and the discharge capacitor branch 27 are active. As shown in FIGS. 9 and 10, during the last $2^N$ row periods of the conversion frame, the clock phase signals $\Phi_1$-$\Phi_3$ and $\Phi_{1B}$-$\Phi_{3B}$ control the switches of the sample and hold circuit 12. Thus, during each active row period of the conversion frame, a negative voltage substantially proportional to the difference between the capacitances $C_{REF}$ and $C_{DIS}$ of the reference and discharge capacitors is decremented from the output voltage $V_{OUT}$ of the integrator 20.

During each active row period of the conversion frame, the comparator 21 is enabled by a sampling pulse SAM whose timing is illustrated in FIG. 10. When enabled by this pulse, the comparator 21 compares the output $V_{OUT}$ of the integrator 20 with a reference voltage $V_{REF}$ and supplies an output pulse for each sampling period when the integrator output voltage is greater than the reference voltage. The reference voltage $V_{REF}$ may be any suitable voltage, for example ground potential or a potential derived as described hereinafter. At the end of the conversion frame, the counter 22 holds a value, for example in binary code, proportional to the capacitance of the liquid crystal capacitor 11 and hence representing a measure of the temperature of the liquid crystal material. The integrator 20 is re-set by means of a re-set pulse RST which closes the switch $S_7$ so that the apparatus is ready to repeat the whole conversion cycle whenever required.

The apparatus thus provides an accurate measurement of the actual temperature of the liquid crystal material and, as described hereinbefore, this may be used in a temperature compensation arrangement, for example to vary the pixel drive voltages so as to reduce the dependence of image appearance and quality on temperature. The temperature sensing arrangement is operated in synchronism with the AMLCD timing so that measurement of the liquid crystal capacitance occurs when the display common electrode is at a known settled potential. Thus, the effects of voltage-dependence are substantially reduced or eliminated. Further, because the complement or inverse of the common electrode potential is used for charging the liquid crystal capacitor, DC balance is maintained across the liquid crystal capacitor 11 so as substantially to avoid degradation of the liquid crystal material forming the capacitor dielectric.

A possible reduction in accuracy of measurement of the example illustrated in FIG. 8 results from the fact that the row periods during which the voltage VCOMB is at ground potential are used in the conversion cycle. Thus, during the even-numbered row periods of the first frame shown in FIG. 3, the output voltage of the sample and hold circuit 12 is nominally zero volts. However, because of errors caused by parasitic effects, such as charge injection from the electronic switches of the sample and hold circuit 12, the output voltage may differ sufficiently significantly from zero to affect the accuracy of the capacitance, and hence temperature, measurement.

In order to avoid this possible disadvantage, the example shown in FIG. 8 may be arranged to perform the sampling only during row periods where the voltage VCOMB is at its high level as illustrated in FIG. 4.

Figure 11:
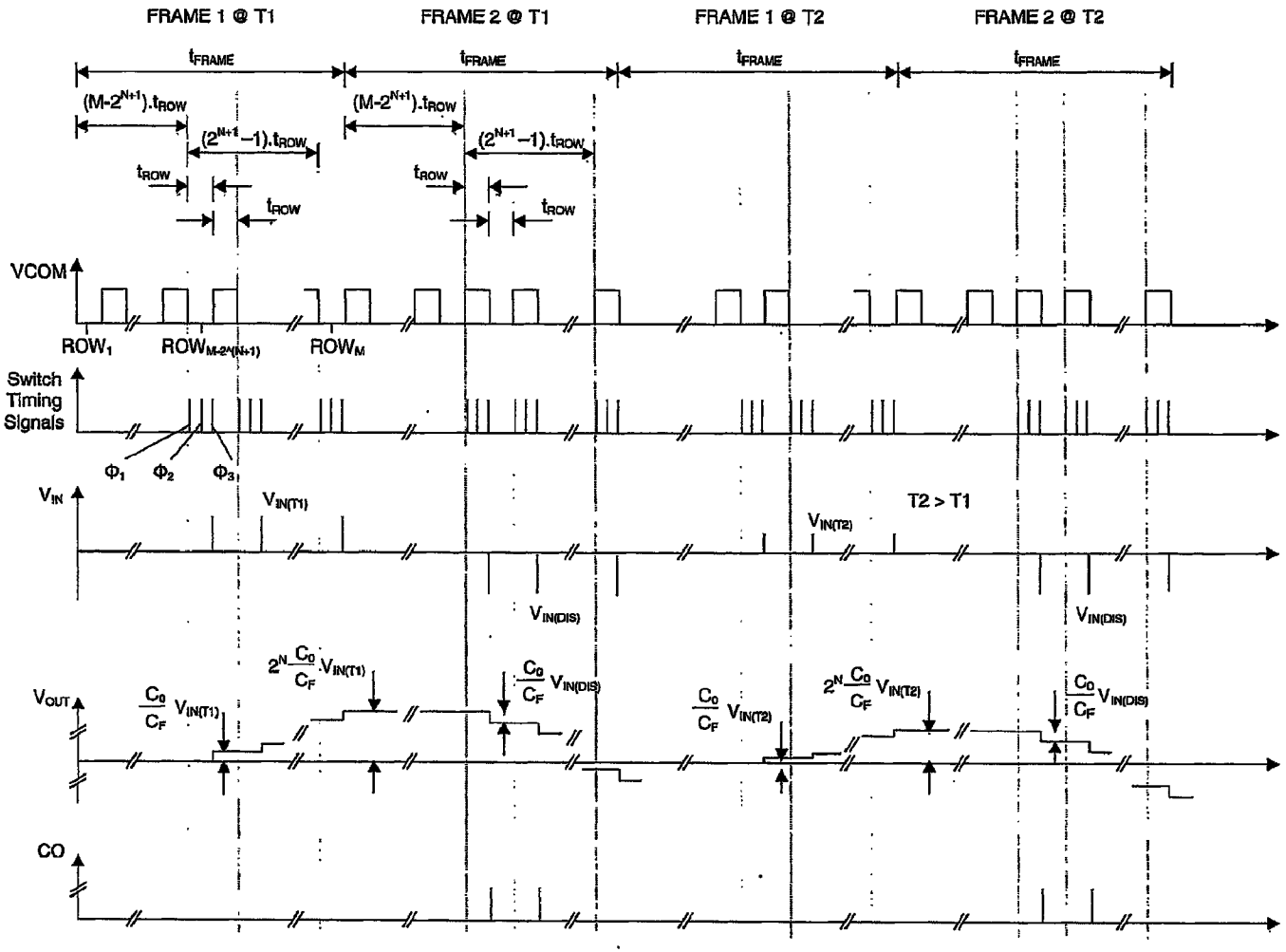
FIGS. 11 and 12 correspond to FIGS. 9 and 10, respectively, but illustrate an alternative mode of operation.
Figure 12:
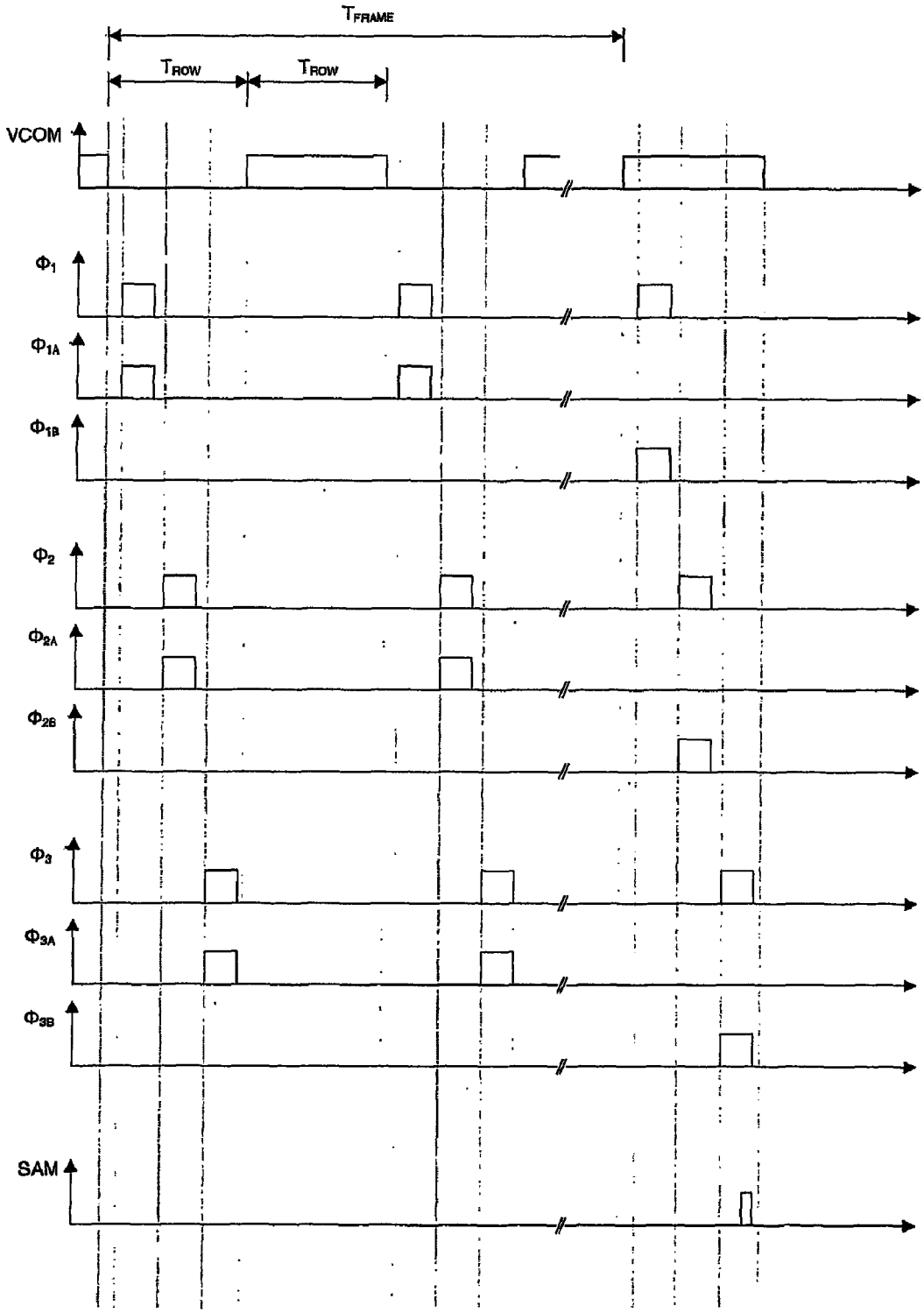

The waveform diagram of FIG. 11 illustrates this mode of operation and the modified clock phase timing is illustrated in the timing diagram of FIG. 12. The individual sampling and conversion operations are thus performed for every second row period when the liquid crystal, reference and discharge capacitors are charged to the higher potential of the signal VCOMB. Because $2^N$ row periods are required to be active for generating the up and down slopes of the N-bit ADC 13, the sampling and conversion periods occupy the last $2^{N+1}$ row periods of the sampling and conversion frames.

In order to maintain DC balancing of the liquid crystal capacitor 11, its first electrode is connected to receive the signal VCOMB during the active row periods of the second or conversion frame of each conversion cycle.

Figure 13:
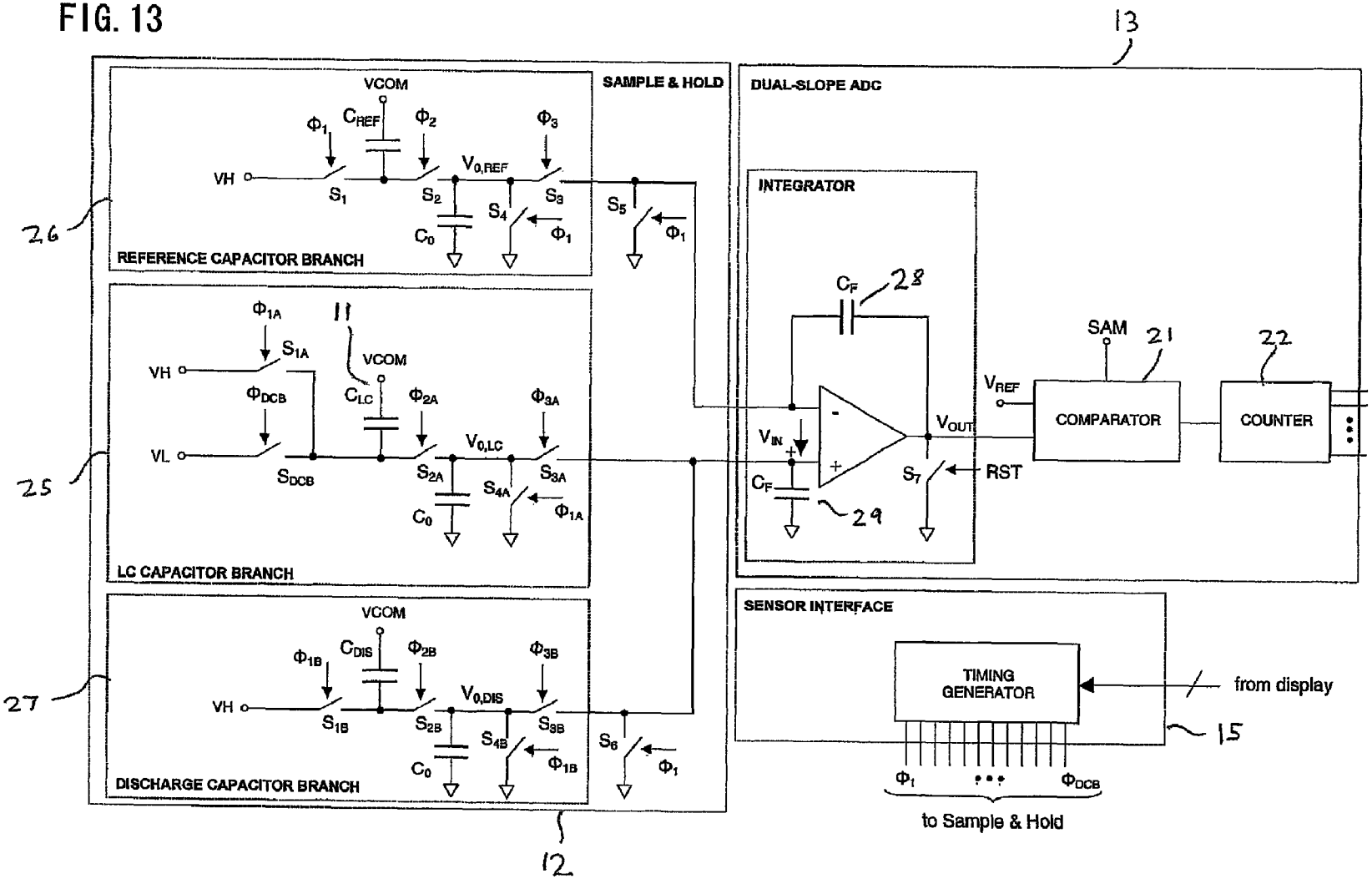
FIG. 13 is a circuit diagram illustrating a second example of the arrangement shown in FIG. 6.
Figure 14:
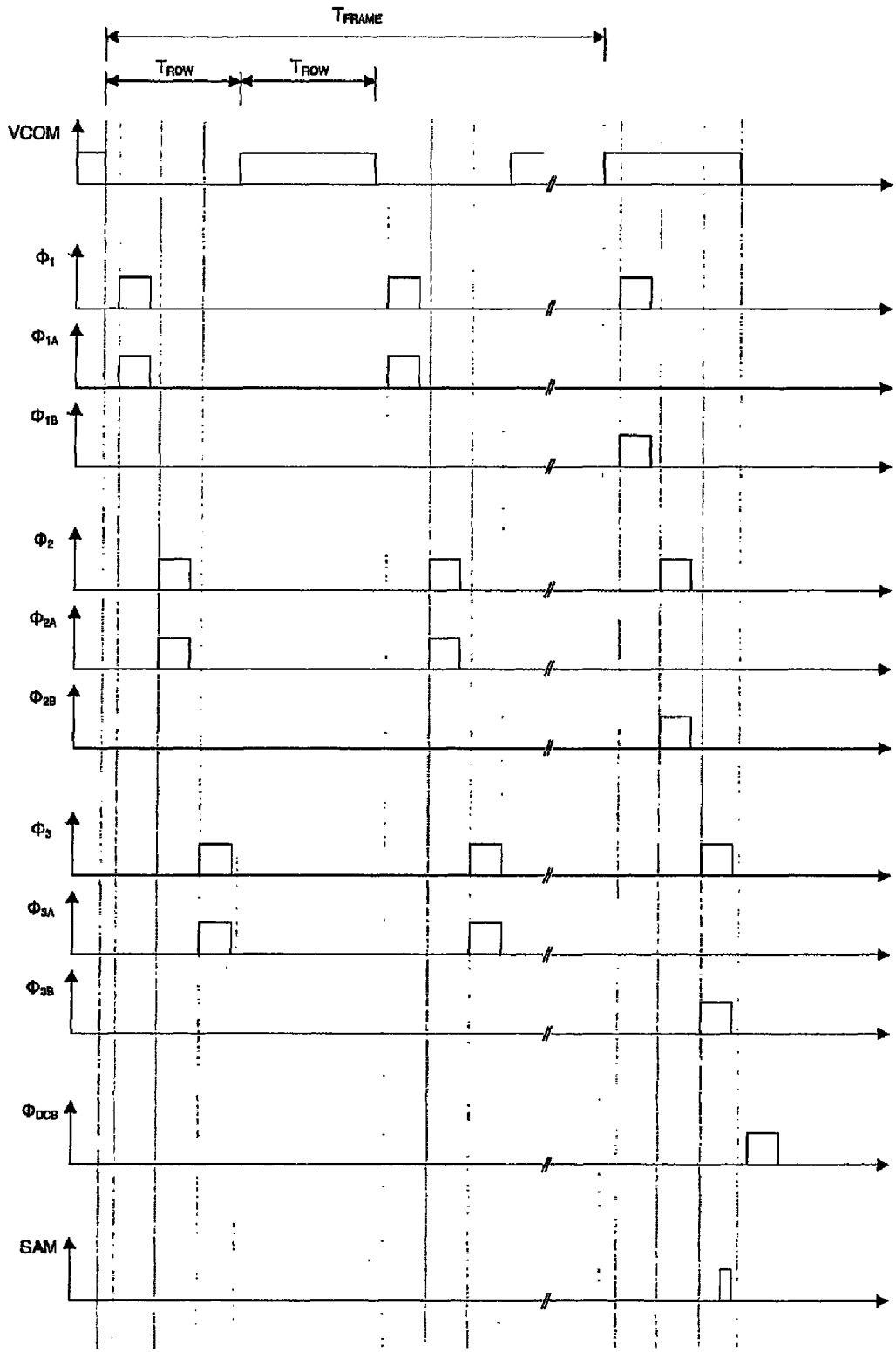
FIG. 14 is a timing diagram illustrating operation of the example shown in FIG. 13.

The example illustrated in FIG. 8 requires that the additional signal VCOMB be generated and supplied to the AMLCD. However, this may be avoided, in the case of an AMLCD with digital driver circuits integrated onto the display substrate, as shown in the example illustrated in FIG. 13. In particular, the voltages $V_H$ and $V_L$ are supplied as reference voltages for digital-to-analog converters forming part of the AMLCD and these voltages are symmetrical around the voltage VCOM of the common terminal so that DC balance of the liquid crystal material in each pixel may be maintained by means of a suitable modulation scheme. Thus, as shown in FIG. 13, the upper voltage $V_H$ may be used for charging the liquid crystal, reference and discharge capacitors in the branches 25-27 during the clock phase signals $\Phi_1$, $\Phi_{1A}$ and $\Phi_{1B}$. In order to provide DC balancing of the liquid crystal capacitor 11, an additional switch $S_{DCB}$ is provided and controlled by a clock phase signal $\Phi_{DCB}$ as shown in FIG. 14. Where the reference and discharge capacitors are not of the liquid crystal type but employ, conventional dielectrics, they do not require such DC balancing.

Figure 15:
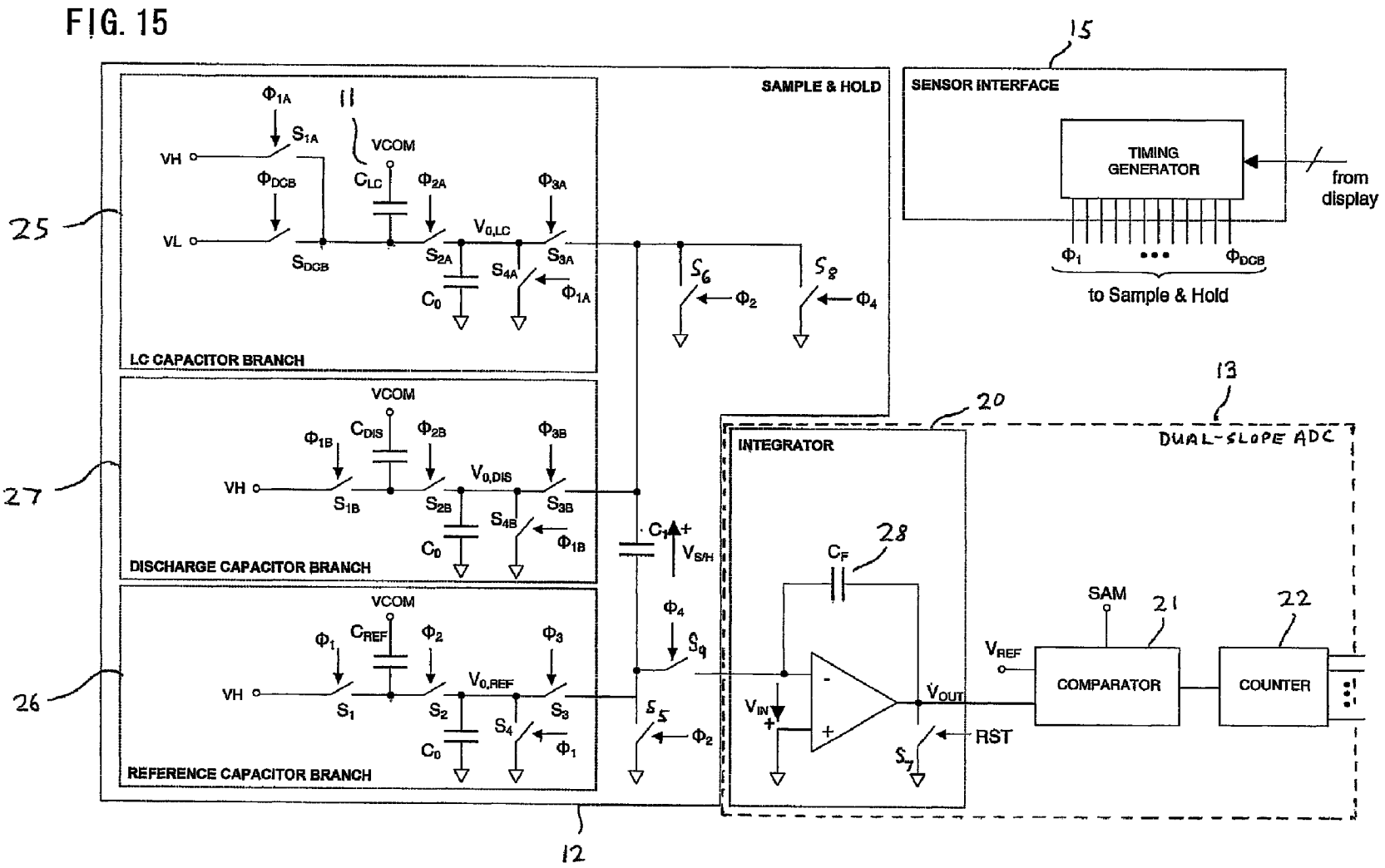
FIG. 15 is a circuit diagram illustrating a third example of the arrangement shown in FIG. 6.

The example illustrated in FIG. 15 differs from that illustrated in FIG. 13 in that the positive or non-inverting input of the integrator 20 is connected to a known reference voltage, such as ground potential, and a summation capacitor $C_1$ is connected between the negative or inverting input of the integrator 20 and the outputs of the liquid crystal capacitor and discharge capacitor branches 25 and 27. Also, the switches $S_5$ and $S_6$ are controlled by the second clock phase signal $\Phi_2$ and two further switches $S_8$ and $S_9$ are controlled by a further clock phase signal $\Phi_4$. The switch $S_9$ is connected between the inverting input of the integrator 20 and the first terminal of the capacitor $C_1$ whereas the switch $S_8$ is connected between the second terminal of the capacitor $C_1$ and ground.

The operation of this example during each row period is the same as described hereinbefore to the point where the clock phase signals $\Phi_3$ and $\Phi_{3A}$ or $\Phi_{3B}$ are active, at which point the output voltage of the sample and hold circuit 12 is transferred to the summation capacitor $C_1$, which was previously fully discharged by the switches $S_5$ and $S_6$ during the clock phase signal $\Phi_2$.

An advantage of this example with the summation capacitor $C_1$ is that the overall size of the apparatus 10 may be reduced. In the examples illustrated in FIGS. 8 and 13, the ratios of the capacitances $C_{LC}$, $C_{DIS}$ and $C_{REF}$ to the transfer capacitance $C_O$ and of the transfer capacitance to the feedback capacitance $C_F$ must be such that, for example, $C_{LC}=C_O=kC_F$, where 1/k determines the gradient of the upslope produced by the integrator 20. It is desirable to make $C_{LC}$ relatively large so as to reduce process mismatch errors and, for a high output bit resolution, k must be made greater than unity to avoid saturation of the integrator 20. For example, a typical value of k is 5. Thus, the capacitors which are required are relatively large compared with the accompanying active circuitry so that a relatively large area is needed in which to integrate the apparatus 10.

The apparatus 10 is required to be integrated on a fringe area of the display substrate and it is desirable to minimise the required area in order to reduce the fringe size of the AMLCD. The use of the summation capacitor $C_1$ removes the need for the feedback capacitor 29 at the non-inverting integrator input and removes the dependency of the capacitance $C_F$ of the capacitor 28 on the capacitance $C_O$ of the transfer capacitors. The capacitance of the summation capacitor is not directly related to, for example, the liquid crystal capacitance $C_{LC}$ and may be made substantially smaller than $C_O$ without increasing the effect of process mismatch errors. The feedback capacitor 28 still has a value related to that of the summation capacitor and so may also be reduced in size. Also, with such an arrangement, it is easier to provide offset removal or compensation for the integrator 20.

Figure 16:
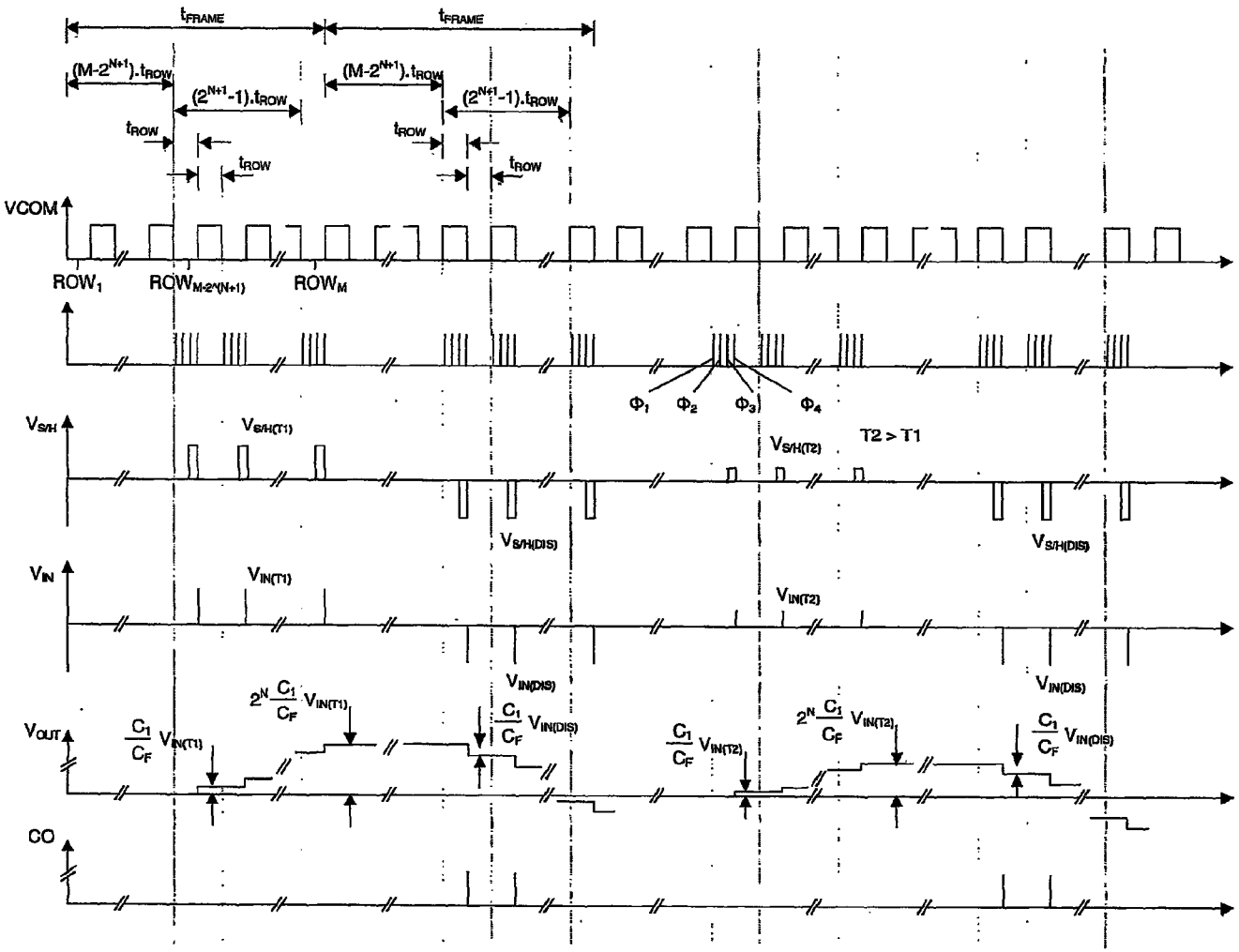
FIGS. 16 and 17 are waveform and timing diagrams illustrating operation of the example shown in FIG. 15.
Figure 17:
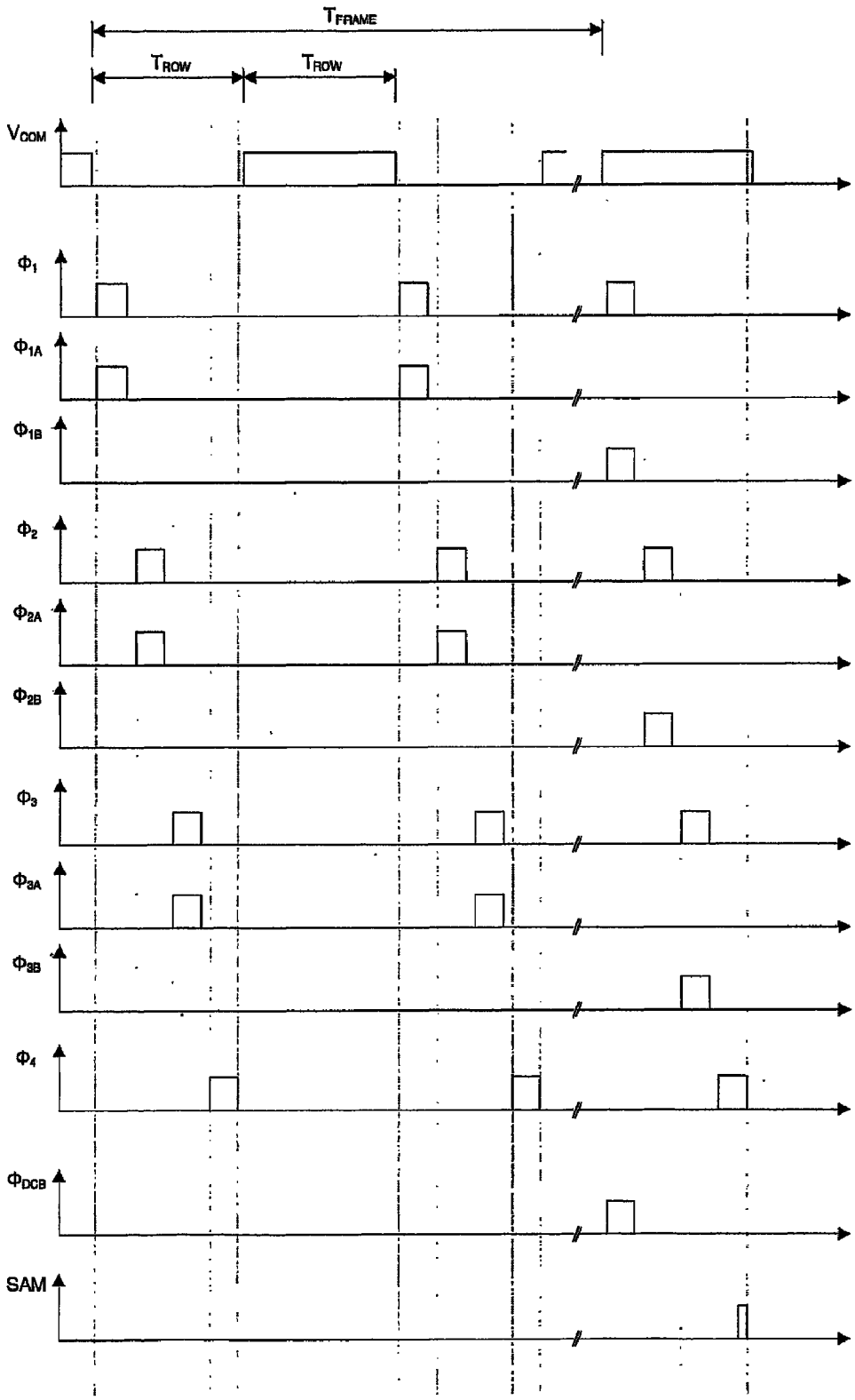

FIGS. 16 and 17 are waveform and timing diagram which illustrate the operation of the example shown in FIG. 15. FIG. 16 is similar to FIG. 11 but shows the output signal $V_{S/H}$ of the circuit 12 instead of the switch timing signals. FIG. 17 differs from FIG. 14 in that it shows the clock phase signal $\Phi_4$.

Figure 18:
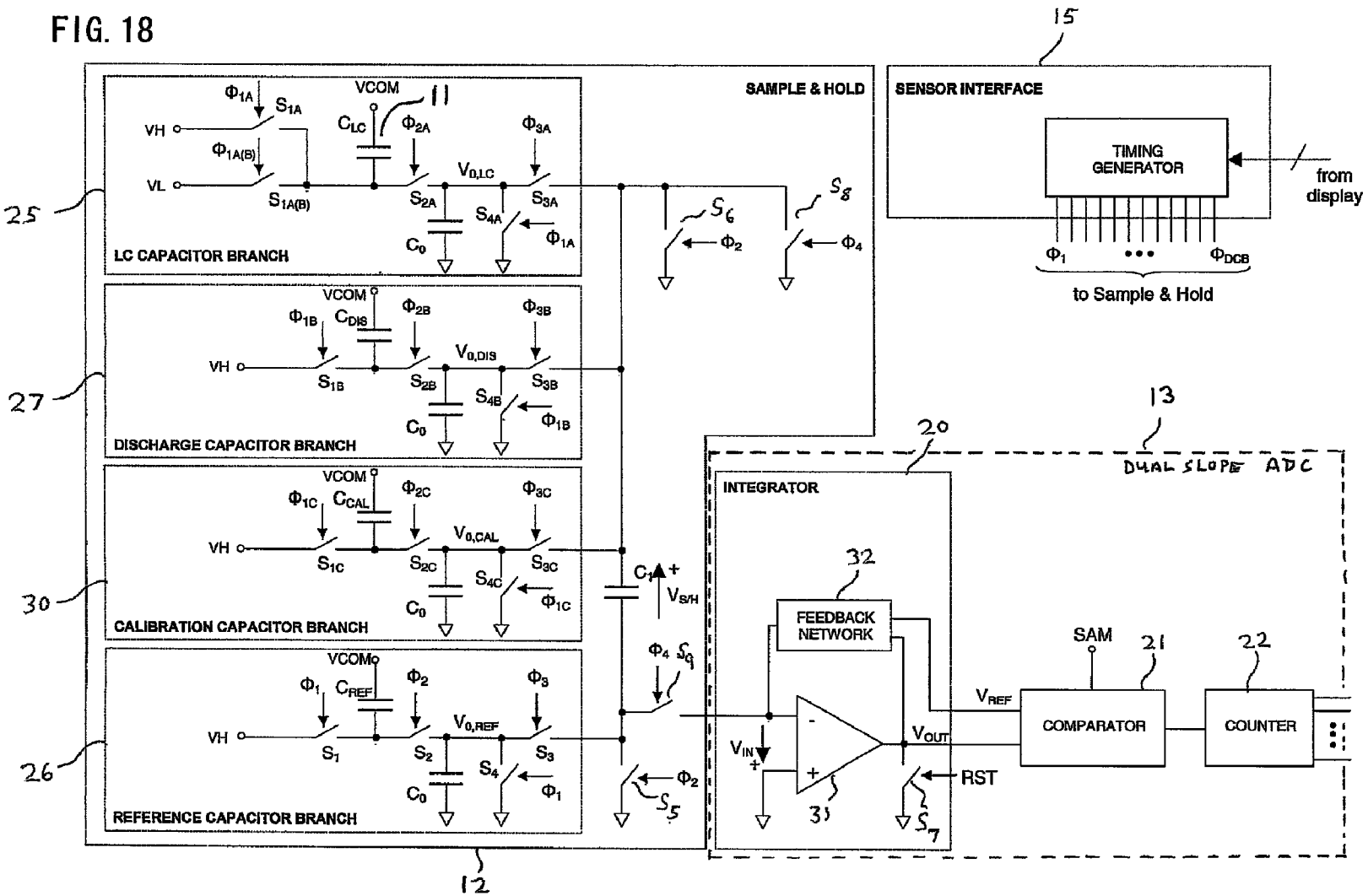
FIG. 18 is a circuit diagram illustrating a fourth example of the arrangement shown in FIG. 6.

FIG. 18 illustrates another example of the apparatus 10 which differs from that shown in FIG. 15 in that a calibration capacitor branch 30 is provided and comprises a calibration third capacitor $C_{CAL}$, another transfer capacitor $C_O$, and first to fourth electronic switches $S_{1C}$-$S_{4C}$ controlled by clock phase signals $\Phi_{1C}$-$\Phi_{3C}$, respectively. The branch 30 forms a third capacitance to voltage converting circuit. The first to third capacitors $C_{LC}$ (11), $C_{REF}$ and $C_{CAL}$ are therefore part of the first to third capacitance to voltage converting circuits 25, 26 and 30, respectively. The output of the branch is connected to the same terminal of the summation capacitor $C_1$ as the liquid crystal and discharge capacitor branches 25 and 27. Also, the integrator comprises an operational amplifier 31 provided with a feedback network 32, which replaces the feedback capacitor 28 and provides the reference voltage $V_{REF}$ to the comparator 21.

The capacitors $C_{LC}$ (11), $C_{DIS}$, $C_{CAL}$ and $C_{REF}$ are illustrated as forming part of the sample and hold circuit 12. However, this is mainly for convenience of illustration and each of these capacitors: may form part of the circuit or may be distinct from or external to the circuit 12.

Figure 19:
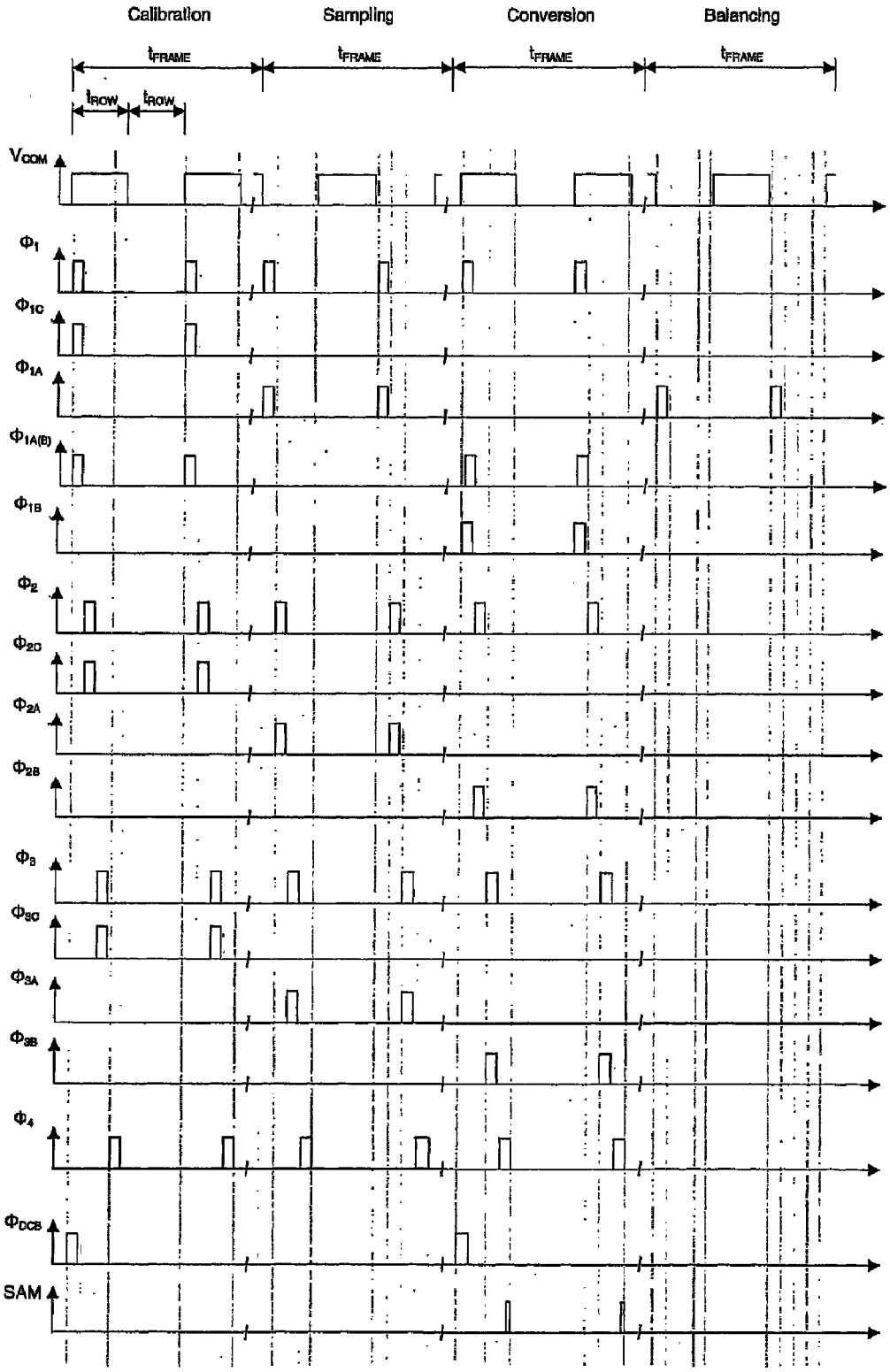
FIG. 19 is a timing diagram illustrating operation of the example shown in FIG. 18.

As illustrated by the timing diagram in FIG. 19, each conversion cycle includes an initial frame period during which calibration is performed and a final frame period during which DC balancing performed, with the sampling and conversion frames being disposed therebetween. During the calibration frame, the calibration and reference capacitor branches 30 and 26 are active and the feedback network 32 is arranged to present a capacitance $C_F$ between the inverting input and the output of the operational amplifier 31. The capacitor charging, charge transfer, difference forming and integrating operations are as described hereinbefore so that, during the active row periods, the sample and hold circuit 12 provides a first signal which is dependent on the difference between the values $C_{REF}$ and $C_{CAL}$ of the reference and calibration capacitors. The calibration and reference capacitors are of nominally equal capacitance so that, in the absence of any errors introduced by the practical implementation of this example, the output voltage of the integrator 20 would be zero. The integrator 20 integrates the first signal to provide an output voltage $V_{OUT}$.

However, errors are introduced by such a practical implementation. For example, such errors are caused by charge-injection effects resulting from finite parasitic capacitances of the transistor-based switches so that the actual output voltage of the integrator 20 during the calibration frame provides a voltage which may be used as the reference voltage for the comparator 21 in order to reduce or eliminate such errors.

During the sampling frame periods, the sample and hold circuit 12 provides a second signal which is dependent on the difference between the values $C_{LC}$ and $C_{REF}$ of the liquid crystal and reference capacitors. During the conversion frame periods, the sample and hold circuit 12 provides a third signal which is dependent on the difference between the values $C_{DIS}$ and $C_{REF}$ of the discharge and reference capacitors.

During the sampling and conversion frame periods, a capacitor (which forms part of the reference voltage generator but is not shown in FIG. 18) storing the reference voltage is disconnected from the operational amplifier 31 and used to provide the reference voltage to the comparator 21. Another feedback capacitor (not shown in FIG. 18) of the same capacitance $C_F$ is connected by the feedback network 32 between the inverting input and the output of the operational amplifier 31 and the sampling and conversion operations described hereinbefore are performed. The compensating voltage reference supplied to the comparator 21 at least partially compensates for the errors mentioned above so as to provide a more accurate measure of the liquid crystal capacitance and hence of the temperature of the liquid crystal material.

In order to provide DC balancing to balance the polarity of the field applied across the liquid crystal forming the dielectric of the first capacitor 11 so as to reduce or avoid degradation of the liquid crystal layer, a fourth "balancing" frame is required as illustrated in FIG. 19. Ideally, the polarity should be completely balanced but, in practice, this cannot be achieved with total precision. For example, the degree of polarity balance depends, among other things, on the voltage levels and the timing of rising and falling edges of signals. These can never be absolutely precise and accurate, for example, because of the inevitable tolerances in components. Provided the balance is sufficiently good to avoid deterioration of the liquid crystal material during the working life of the device, this will be sufficient. In the first calibration frame, the switch $S_{1A(B)}$ is closed by the clock phase signal $\Phi_{1A(B)}$ to connect the liquid crystal capacitor 11 to the lower drive voltage $V_L$ during each active row period. During these row periods, the common electrode is at the higher voltage.

During the second sampling frame, the liquid crystal capacitor is connected to the higher drive voltage $V_B$ and the common electrode is at its lower voltage during the active row periods. During the conversion frame, the liquid crystal capacitor is at the lower drive voltage and the common electrode is at the higher voltage during the active rows. Accordingly, in order to provide DC balancing during the active rows of the balancing frame, the liquid crystal capacitor is charged to the higher drive voltage and the common electrode is at the lower voltage.

Figure 20:
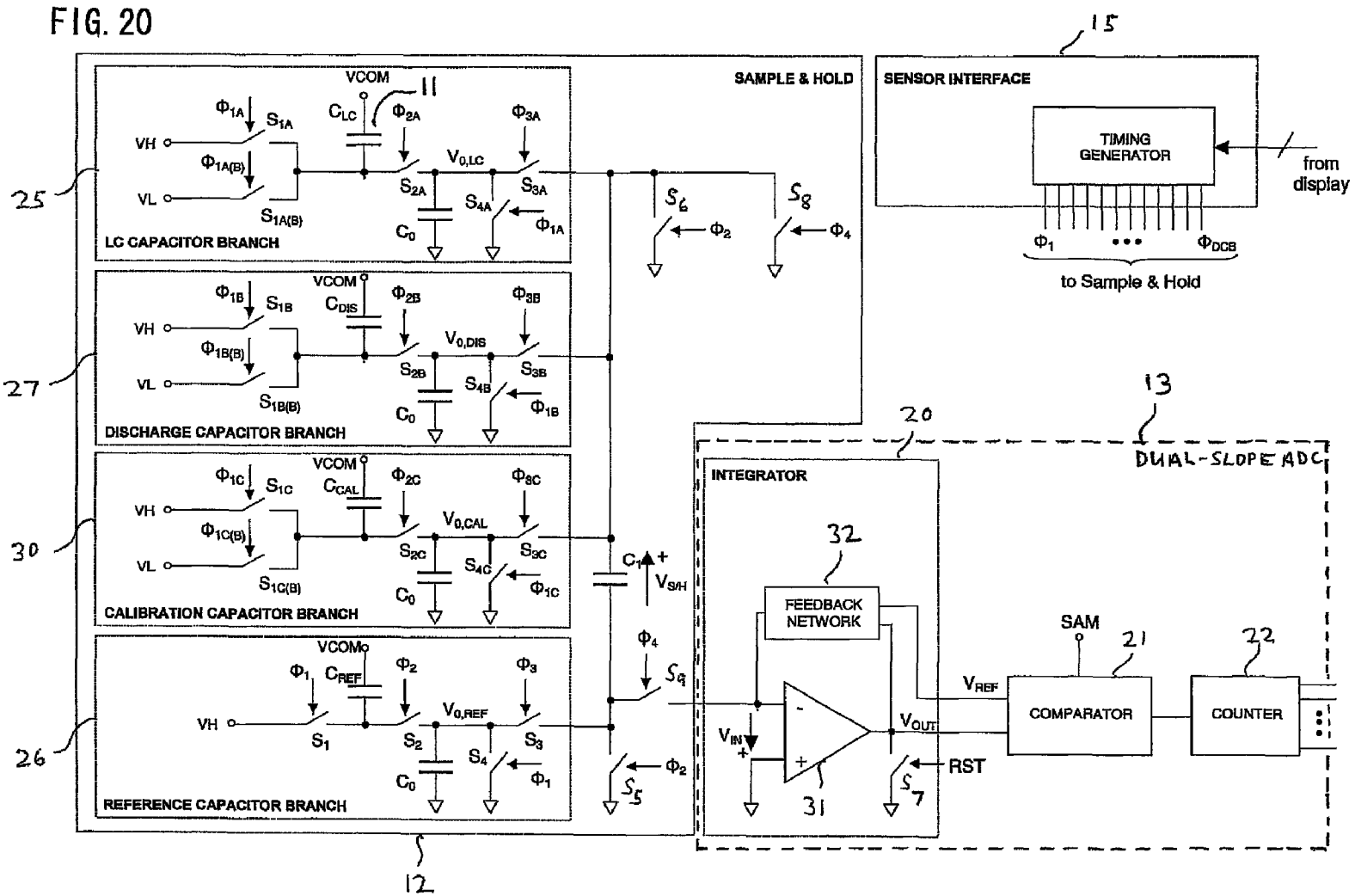
FIG. 20 is a circuit diagram illustrating a fifth example of the arrangement shown in FIG. 6.

The example illustrated in FIG. 20 differs from that shown in FIG. 18 in that the calibration and discharge capacitors $C_{CAL}$ and $C_{DIS}$ are embodied as liquid crystal capacitors biased to operate in the temperature independent region. In particular, the timing is such that the calibration and discharge capacitors $C_{CAL}$ and $C_{DIS}$ are "measured" with a relatively low voltage across them. This low voltage is selected to be in the voltage range where capacitance is substantially independent of temperature, for example as illustrated in FIG. 2 for voltages below about 1.5 volts.

The basic, operation of this example is the same as for that of FIG. 18 except that DC balancing has to be provided in respect of the calibration and discharge capacitors. This is achieved by providing switches $S_{1A(B)}$-$S_{1C(B)}$ controlled by clock phase signals $\Phi_{1A(B)}$-$\Phi_{1C(B)}$, respectively, for connecting the capacitors to the lower drive voltage $V_L$. The waveform diagram of FIG. 19 applies to the example of FIG. 20. However, the additional clock phase signals are such that:

the liquid crystal capacitor 11 is connected to the lower drive voltage $V_L$ during the calibration and conversion frames and to the higher voltage $V_H$ during the sampling and balancing frames;

the calibration capacitor is connected to the higher voltage $V_H$ during the calibration and conversion frames and to the lower voltage $V_L$ during the sampling and balancing frames; and the discharge capacitor is connected to the higher voltage $V_H$ during the calibration and conversion frames and to the lower voltage $V_L$ during the sampling and balancing frames.

An advantage of this example is that accuracy of measurement is increased because of improved matching of capacitors of similar construction. In particular, the liquid crystal, discharge and calibration capacitors are all liquid crystal capacitors and may be matched more closely than for the previous examples, in which the liquid crystal capacitor is of a different construction from the conventional dielectric discharge and calibration capacitors. Although the reference capacitance $C_{REF}$ should be of a value similar to the liquid crystal capacitance $C_{LC}$, the reference capacitor should not be a liquid crystal capacitor because any mismatch is removed by means of the calibration frame.

Figure 21:
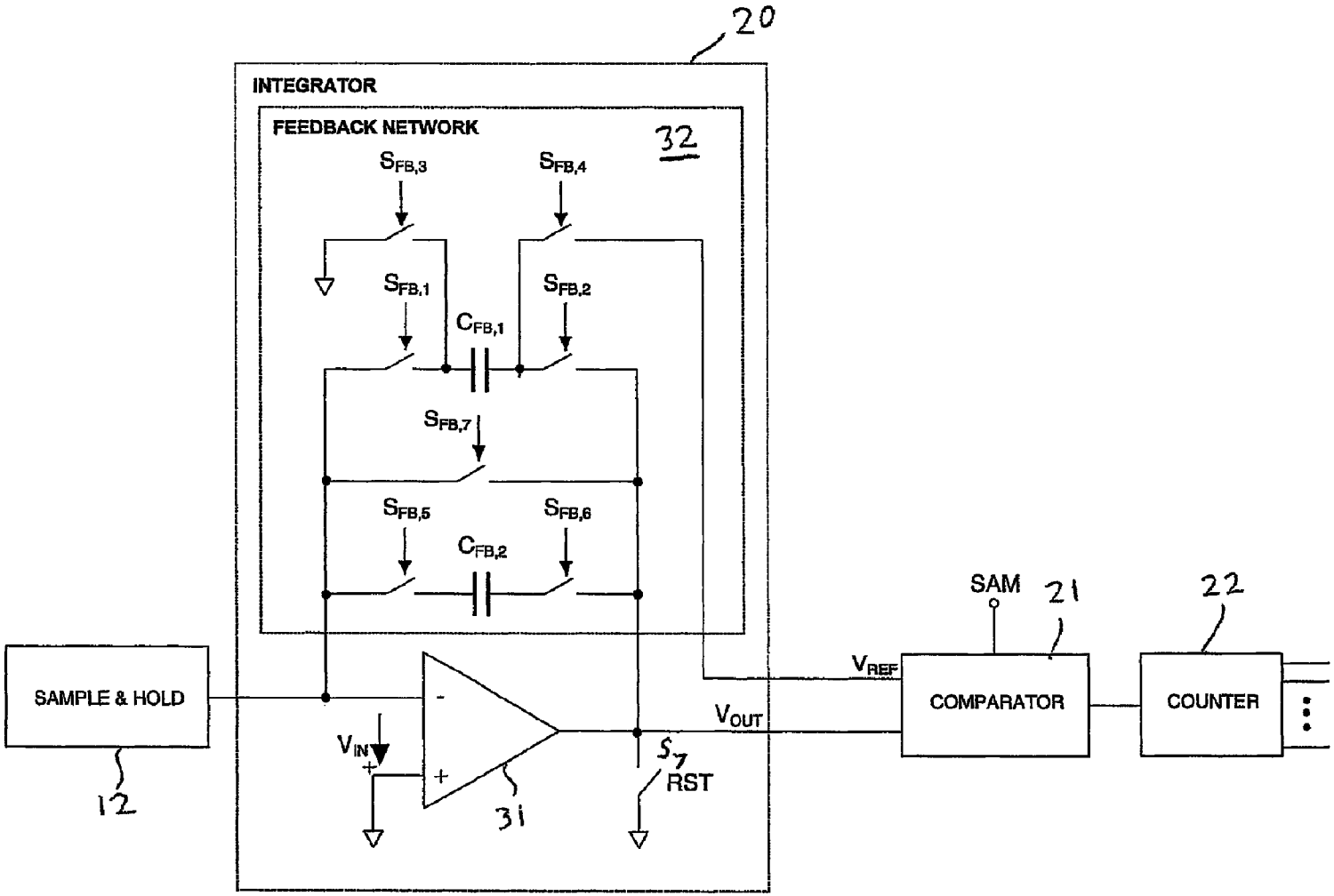
FIG. 21 is a circuit diagram illustrating a reference voltage generator of the arrangement shown in FIG. 6.

FIG. 21 illustrates an example of the feedback network 32 connected between the inverting input and the output of the operational amplifier 31 and supplying the reference voltage $V_{REF}$ to the comparator 21. The feedback network 32 comprises electronic switches $S_{FB.1}$-$S_{FB.7}$ and integrating fourth and fifth capacitors $C_{FB.1}$ and $C_{FB.2}$. This arrangement allows a calibration voltage to be generated during the calibration frame and subsequently stored as a reference voltage for the comparator 21 during the third conversion frame. During each of the frames of each conversion cycle, the feedback network 32 presents a capacitance $C_F$ between the inverting input and the output of the operational amplifier 31.

During the calibration frame, the switches $S_{FB.1}$ and $S_{FB.2}$ are closed so that the capacitor $C_{FB.1}$ is connected between the inverting input and the output of the operational amplifier 31. The switches $S_{FB.7}$ and $S_7$ are briefly closed so as to reset the terminals of the capacitor $C_{FB.1}$ to ground potential. The calibration frame then proceeds as described hereinbefore so that, at the end of the calibration frame, the voltage stored across the capacitor $C_{FB.1}$ is equal to the integrator output error voltage.

During the next three frames, the switches $S_{FB.1}$ and $S_{FB.2}$ are opened whereas the switches $S_{FB.3}$-$S_{FB.6}$ are closed. The switches $S_{FB.7}$ and $S_7$ are briefly closed to reset the terminals of the capacitor $C_{FB.2}$ to ground potential. The integrator output voltage during the calibration frame is thus supplied to the comparator 21 as the reference voltage $V_{REF}$ for use during the conversion frame. The capacitor $C_{FB.2}$ acts as the integrating capacitor during the sampling, conversion and balancing frames of each conversion cycle.

Figure 22:
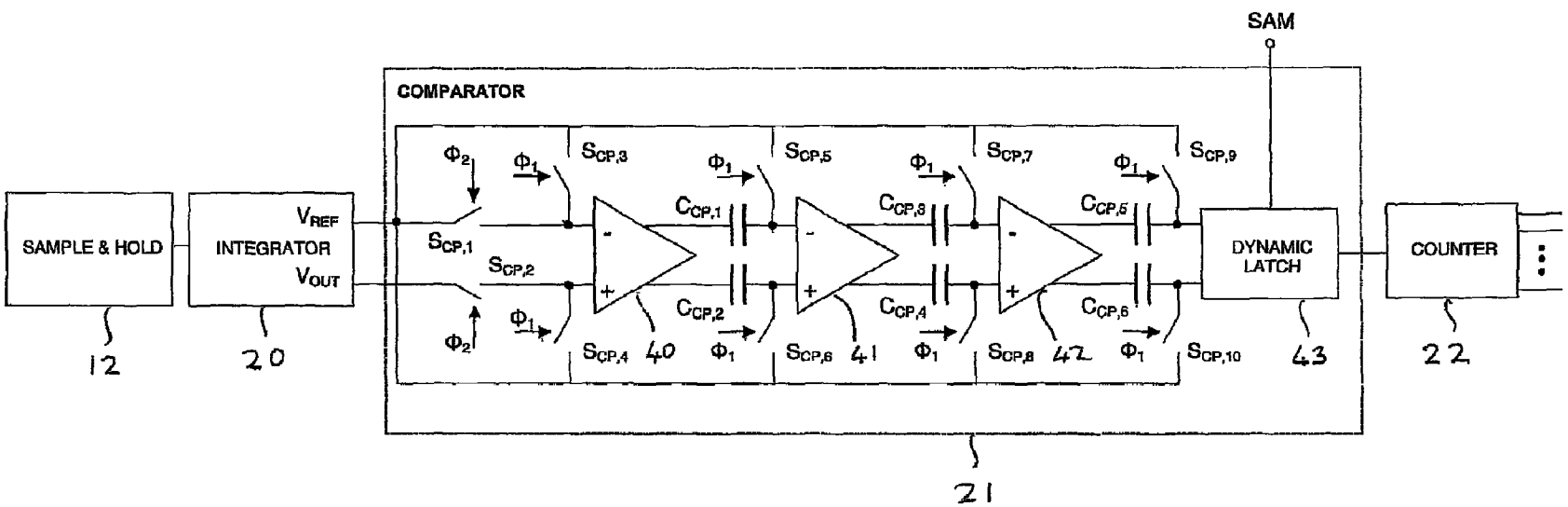
FIG. 22 is a circuit diagram illustrating a comparator of the arrangement shown in FIG. 6.

FIG. 22 illustrates an example of the comparator 21 including offset correction circuitry, for example of the type disclosed in R. Gregorian "Introduction to CMOS Op Amps and Comparators", John Wiley and Sons, 1999. The reference voltage supplied by the feedback network of the integrator 20 is additionally used to provide a reference voltage for offset removal.

The comparator 21 comprises cascaded operational amplifiers 40, 41 and 42, a dynamic latch 43 which receives the sampling pulse SAM, offset storage capacitors $C_{CP.1}$-$C_{CP.6}$, electronic switches $S_{CP.1}$ and $S_{CP.2}$ controlled by the clock phase signal $\Phi_2$, and electronic switches $S_{CP.3}$-$S_{CP.10}$ controlled by the clock phase signal $\Phi_1$.

The offsets of the amplifiers 40, 41 and 42 may vary with their respective input voltages. For example, if the offsets are removed at a particular voltage, then residual offset errors may exist at other operational voltages. For improved accuracy, such offsets should be removed under the same conditions as will prevail during operation. In this example, the offsets are removed at the reference voltage so as to improve conversion accuracy.

During a first phase of offset removal, the switches $S_{CP.3}$-$S_{CP.10}$ are closed so that the offsets of the individual stages are measured and stored on the capacitors $C_{CP.1}$-$C_{CP.6}$. The amplifier offset voltages are measured at the operating point specified by the reference voltage $V_{REF}$.

During the second phase of offset removal, the switches $S_{CP.3}$-$S_{CP.10}$ are opened and the switches $S_{CP.1}$ and $S_{CP.2}$ are closed so that the input of the first amplifier 40 is connected to the comparator input. The comparator thus operates as normal and, because the individual offset voltages remain stored across the capacitors $C_{CP.1}$-$C_{CP.6}$, errors arising from the amplifier offset voltages are substantially eliminated or greatly reduced.

The comparator offset removal cycle need only be performed once at the start of each conversion frame. Alternatively, in order to reduce errors caused by leakage from the offset storage capacitors $C_{CP.1}$-$C_{CP.6}$, the offset removal cycle may be performed at the beginning of every row period of the conversion frame.

Figure 23:
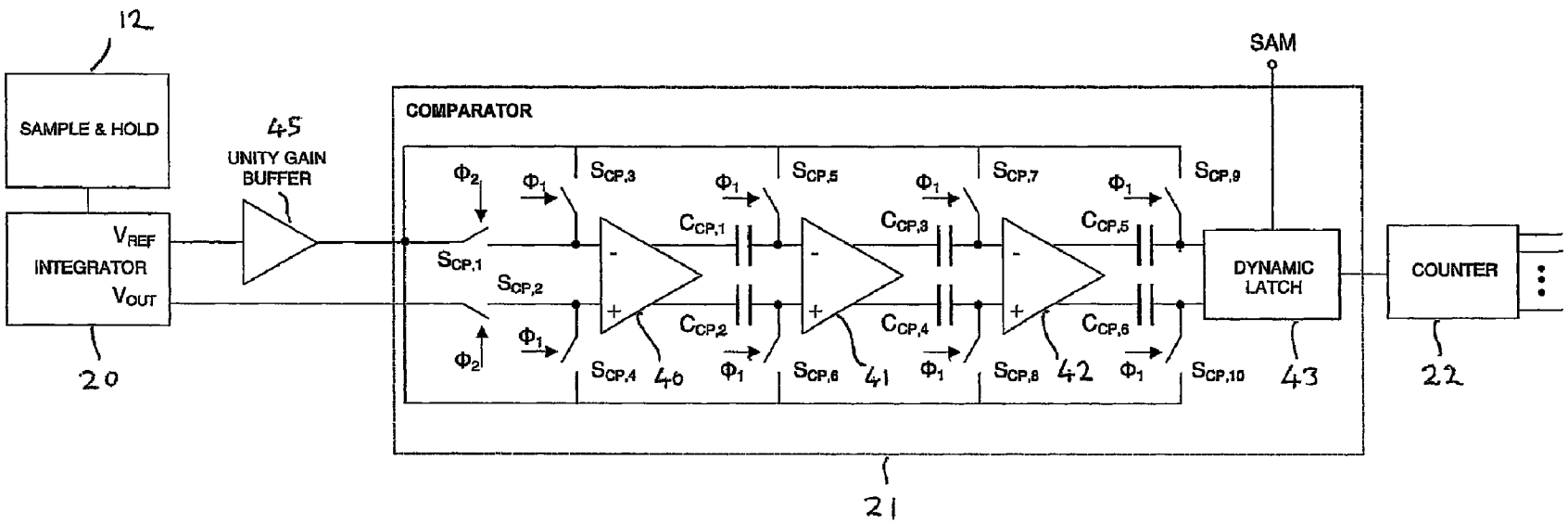
FIG. 23 is a circuit diagram of a modified comparator of the type shown in FIG. 22.

The arrangement illustrated in FIG. 23 differs from that shown in FIG. 22 in that a unity gain buffer 45 buffers the reference voltage generator $S_{FB.1}$-$S_{FB.4}$, $C_{FB.1}$ in the integrator 20 from loading effects of the comparator 21. Thus, the integrator output error voltage stored on the capacitor $C_{FB.1}$ is not substantially disturbed by the comparator offset removal cycle and by measurement operations. A similar offset removal arrangement may be provided for the unity gain buffer 45 and a suitable arrangement is disclosed in G. Cairns et la "Multi-Format Digital Display with Content Driven Display Format", Society for Information Display Technical Digest, 2001 pp. 102-105.

Figure 24:
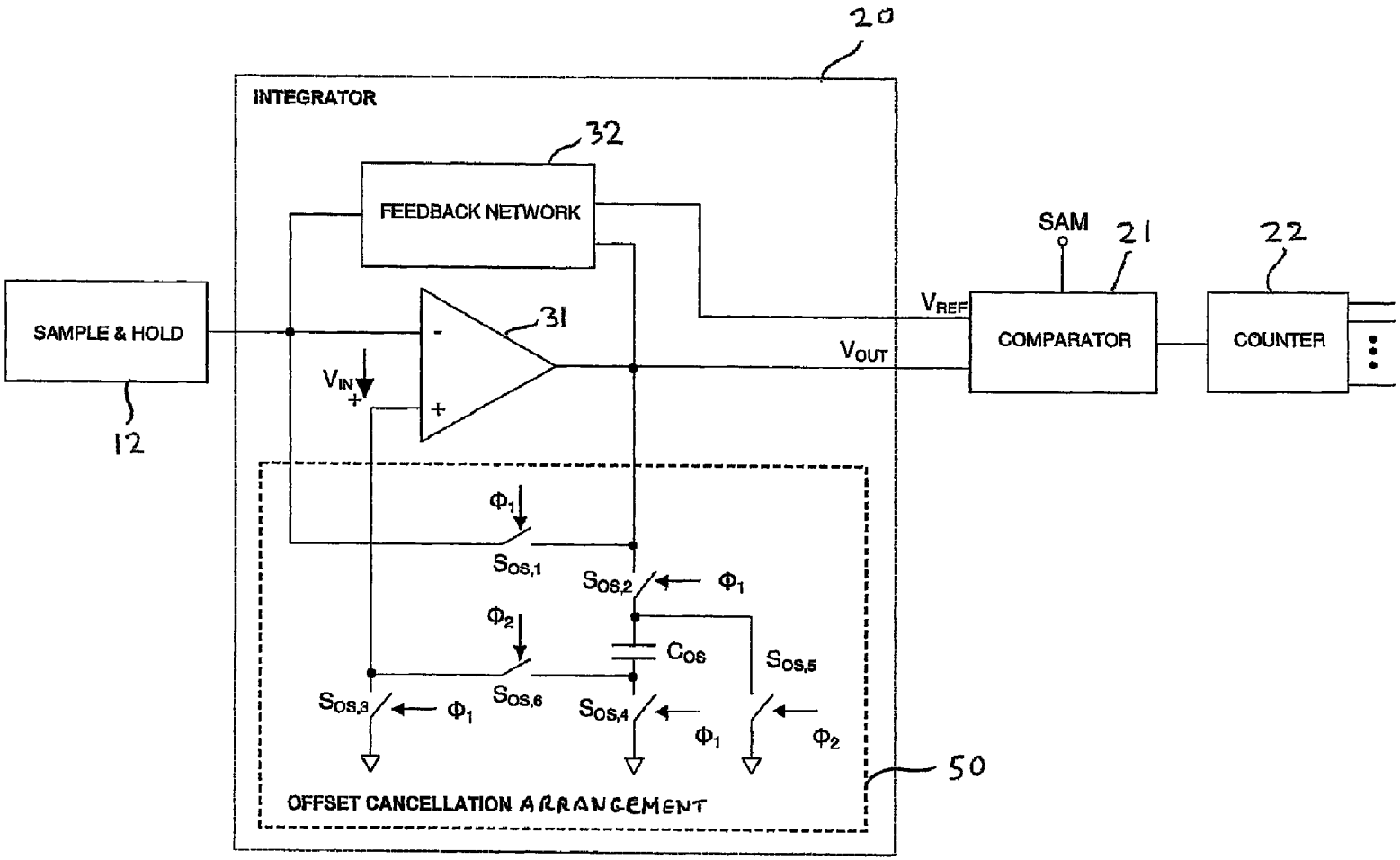
FIG. 24 is a circuit diagram illustrating an offset cancellation circuit of the arrangement of FIG. 6.

FIG. 24 illustrates an offset cancellation arrangement 50 forming part of the integrator 20. Such an arrangement is provided in order to compensate for variations in transistor characteristics within the operational amplifier 31 which might otherwise cause the amplifier to exhibit an input offset error voltage, which may result in conversion error and amplifier saturation. The arrangement comprises an offset storage seventh capacitor $C_{OS}$ and an electronic switching arrangement comprising electronic switches $S_{OS.1}$-$S_{OS.4}$ controlled by a clock phase signal $\Phi_1$ and electronic switches $S_{OS.6}$ and $S_{OS.6}$ controlled by a clock phase signal $\Phi_2$. When used in conjunction with the feedback network 32 described hereinbefore, the switch $S_{OS.1}$ may be embodied by the switch $S_{FB.7}$.

Operation of the offset cancellation arrangement occurs in two phases. In the first phase, the amplifier offset is sampled. In particular, the switches $S_{OS.1}$-$S_{OS.4}$ are closed so that the operational amplifier 31 is connected in an inverting unity gain configuration and the amplifier offset is stored on the capacitor $C_{OS}$. In particular, the output of the amplifier 31 is connected to the inverting input of the amplifier 31 via the switch $S_{OS.1}$ so that the amplifier 31 has a voltage gain of −1 to provide the inverting unity gain configuration. The non-inverting input of the amplifier 31 is connected to ground via the switch $S_{OS.3}$ so that the input offset error voltage appears between the inverting an non-inverting inputs of the amplifier 31. The input offset error voltage appears inverted at the output of the amplifier 31 and hence across the capacitor $C_{OS}$ via the switches $S_{OS.2}$ and $S_{OS.4}$. In the second phase, the switches $S_{OS.6}$ and $S_{OS.6}$ are closed so that the sampled offset voltage is inverted and applied to the non-inverting input terminal of the amplifier 31. Following offset sampling, offset correction is maintained during subsequent operation of the integrator 20.

The amplifier offset voltage may be sampled once during a conversion cycle, for example before the calibration frame when present. The offset voltage then remains stored on the capacitor $C_{OS}$ until a subsequent offset sampling phase. Alternatively, the offset voltage may be sampled at the beginning of each frame of the conversion cycle. As a further alternative, the offset voltage may be sampled at the beginning of each active row period during which the integrator 20 is in operation. This more frequent offset sampling and correction is preferable if charge leakage from the capacitor $C_{OS}$ would result in an error in the stored offset voltage accumulating with time.

The temperature measurement of the liquid crystal material is used to effect a change in the operation of the AMLCD. For example, the driving voltages applied to pixels of the AMLCD may be adjusted in order to compensate the display for temperature-induced changes in the properties of the liquid crystal material. Means for adjusting the display driving voltages may comprise a look-up table and one or more digital/analog converters (DACs) for controlling reference voltages used in display driving circuits. Values stored in the look-up table may be predetermined by experiment to allow the generation of appropriate driving voltages for the measured temperature.

For example, a set of liquid crystal voltage transmission curves for a range of temperatures may be stored in the look-up table and the appropriate or closest curve may be selected on the basis of the measured temperature of the liquid crystal material. Alternatively, a limited set of points may be stored with intermediate values being interpolated so as to generate the appropriate curve for any liquid crystal temperature. A further possibility, as disclosed in U.S. Pat. No. 5,926,162, is to alter the voltage of the common electrode in accordance with the measured temperature.

The temperature of the liquid crystal material in an AMLCD is not a rapidly changing variable. Accordingly, it may be sufficient to perform temperature measurements relatively infrequently in order to reduce power consumption. The frequency of measurement may be predetermined or may be variable and may be set externally by a user or host. Alternatively, the user or host may supply a signal requesting that a temperature measurement cycle be performed. In response to such a request, the apparatus begins a measurement cycle as described hereinbefore at the start of a frame period with the common electrode at a suitable polarity. At the end of the measurement cycle, the output of the counter 22 is stored and made available for providing AMLCD temperature compensation or for any other desired purpose.

For a fuller understanding of the nature and advantages of the invention, reference should be made to the ensuing detailed description taken in conjunction with the accompanying drawings.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

The invention claimed is:

1. An active matrix liquid crystal device comprising:

an active matrix first substrate having an active matrix area;

a second substrate carrying a common electrode for the active matrix;

a layer of liquid crystal material between the first and second substrates;

a temperature sensing first capacitor comprising a first electrode outside the image generating region of the active matrix area on the first substrate separated from the common electrode, which forms a second electrode of the first capacitor, by the liquid crystal layer, which forms the first capacitor dielectric; and a capacitance measuring circuit arranged, during operation of the active matrix, (i) repeatedly to perform the steps of precharging the first capacitor to a substantially fixed stable known first precharge voltage magnitude and forming a signal representing the capacitance of the first capacitor, (ii) to measure the capacitance of the first capacitor in synchronism with addressing of at least one of a plurality of rows included in a pixel matrix, and (iii) to charge the first capacitor to the same magnitude of voltage during each precharging step.

2. A device as claimed in claim 1, in which the measuring circuit is formed on the first substrate.

3. A device as claimed in claim 1, in which measuring circuit is arranged to charge the first capacitor to the same polarity of voltage during each precharging step.

4. A device as claimed in claim 1, in which the measuring circuit is arranged to perform each precharging step at a same part of an active matrix addressing cycle.

5. A device as claimed in claim 4, in which the same part comprises the same part of a line addressing period.

6. A device as claimed in claim 1, in which the active matrix and the common electrode are arranged periodically to invert the polarity of drive voltages applied to pixel cells of the device.

7. A device as claimed in claim 3, in which the active matrix and the common electrode are arranged to invert the polarity during alternate line addressing periods.

8. A device as claimed in claim 7, in which the measuring circuit is arranged to perform the precharging step during alternate line addressing periods.

9. A device as claimed in claim 1, in which the forming step measures the charge stored in the first capacitor during the precharging step.

10. A device as claimed in claim 9, in which the measuring circuit is arranged to measure the stored charge by charge-sharing.

11. A device as claimed in claim 10, in which the measuring circuit is arranged, during each forming step of a first part of a conversion cycle, to share the stored charge with a transfer second capacitor during a first forming phase, and to make the first resulting voltage across the second capacitor available during a second forming phase.

12. A device as claimed in claim 11, in which the measuring circuit is arranged to charge a reference third capacitor to a second precharge voltage during the precharging step, to share the stored charge with a transfer fourth capacitor during the first forming phase, and to make the second resulting voltage across the fourth capacitor available during the second forming phase.

13. A device as claimed in claim 12, in which the third capacitor has a value less than or equal to a lowest-expected value of the first capacitor.

14. A device as claimed in claim 12, comprising means for forming the difference between the first and second resulting voltages.

15. A device as claimed in claim 14, in which the means comprises a summation fifth capacitor arranged to be connected temporarily between the second and fourth capacitors.

16. A device as claimed in claim 14, in which the means comprises a differential input of a following stage.

17. A device as claimed in claim 1, in which the measuring circuit comprises an analog/digital converter.

18. A device as claimed in claim 17, in which the converter is an integrating converter.

19. A device as claimed in claim 18, in which the converter is a dual-slope converter.

20. A device as claimed in claim 12, in which the measuring circuit comprises a dual-slope analog/digital converter and is arranged, during each of repeated discharge cycles of a second part of the conversion cycle, to charge a discharge fifth capacitor to a third precharge voltage during a third phase, to share the stored change with a transfer sixth capacitor during a fourth phase, and to make the third resulting voltage across the sixth capacitor available during a fifth phase.

21. A device as claimed in claim 20, in which the measuring circuit is arranged to charge the third capacitor to a fourth precharge voltage during the third phase, to share the stored charge with the fourth capacitor during the fourth phase, and to make the fourth resulting voltage across the fourth capacitor available during the fifth phase.

22. A device as claimed in claim 21, in which the fifth capacitor has a value less than that of the third capacitor.

23. A device as claimed in claim 1, in which at least one said precharge voltage is derived from a complement of a voltage on the common electrode.

24. A device as claimed in claim 1, in which at least one said precharge voltage is derived from a matrix element drive voltage.

25. A device as claimed in claim 12, in which the measuring circuit is arranged, during each of repeated calibration cycles of an initial part of the conversion cycle, to charge a calibration fifth capacitor to a fifth precharge voltage during a sixth phase, to share the stored charge with a transfer sixth capacitor during a seventh phase, and to make the fifth resulting voltage across the transfer sixth capacitor available during an eighth phase.

26. A device as claimed in claim 25, in which the measuring circuit is arranged to charge the third capacitor to a sixth precharge voltage during the sixth phase, to share the stored charge with the fourth capacitor during the seventh phase, and to make the sixth resulting voltage across the fourth capacitor available during the eighth phase.

27. A device as claimed in claim 25, in which the measuring circuit comprises a reference voltage generator for generating a reference voltage from the fifth resulting voltage.

28. A device as claimed in claim 27, in which the generator comprises a seventh capacitor arranged to integrate the fifth resulting voltages from the calibration cycles.

29. A device as claimed in claim 20, in which the measuring circuit is arranged, during each of repeated calibration cycles of an initial part of the conversion cycle, to charge a calibration seventh capacitor to a fifth precharge voltage during a sixth phase, to share the stored charge with a transfer eighth capacitor during a seventh phase, and to make the fifth resulting voltage across the eighth capacitor available during an eighth phase.

30. A device as claimed in claim 29, in which the measuring circuit comprises a reference voltage generator for generating a reference voltage from the fifth resulting voltage.

31. A device as claimed in claim 30, in which the generator is arranged to supply the reference voltage to a comparator of the converter during the second part of the conversion cycle.

32. A device as claimed in claim 1, in which the signal representing the capacitance provides a measure of the liquid crystal material temperature.

33. A device as claimed in claim 32, comprising an arrangement, responsive to the measure of the liquid crystal material temperature, for supplying temperature-compensated drive signals to the cells of the matrix.

* * * * *